US011223102B2

(12) United States Patent
Jeon

(10) Patent No.: US 11,223,102 B2
(45) Date of Patent: Jan. 11, 2022

(54) ANTENNA ARRAY AND ELECTRONIC DEVICE INCLUDING ANTENNA ARRAY

(71) Applicant: Samsung Electronics Co., Ltd., Gyeonggi-do (KR)

(72) Inventor: Seung Gil Jeon, Gyeonggi-do (KR)

(73) Assignee: Samsung Electronics Co., Ltd (KR)

( * ) Notice: Subject to any disclaimer, the term of this patent is extended or adjusted under 35 U.S.C. 154(b) by 143 days.

(21) Appl. No.: 16/614,710

(22) PCT Filed: May 17, 2018

(86) PCT No.: PCT/KR2018/005660
§ 371 (c)(1),
(2) Date: Nov. 18, 2019

(87) PCT Pub. No.: WO2018/221879
PCT Pub. Date: Dec. 6, 2018

(65) Prior Publication Data

US 2020/0076055 A1 Mar. 5, 2020

(30) Foreign Application Priority Data

May 30, 2017 (KR) ..... 10-2017-0066626

(51) Int. Cl.
*H01Q 1/24* (2006.01)
*H01Q 21/00* (2006.01)
*H01Q 21/06* (2006.01)

(52) U.S. Cl.
CPC ..... *H01Q 1/24* (2013.01); *H01Q 21/0006* (2013.01); *H01Q 21/06* (2013.01)

(58) Field of Classification Search
CPC ..... H01Q 1/24; H01Q 21/0006; H01Q 21/06; H01Q 1/38; H01Q 1/243; H01Q 9/04
See application file for complete search history.

(56) References Cited

U.S. PATENT DOCUMENTS 6,859,174 B2 2/2005 Kane et al.
7,242,352 B2 7/2007 Tavassoli Hozouri
7,298,339 B1 11/2007 Ollikainen
(Continued)

FOREIGN PATENT DOCUMENTS

EP 2 038 962 3/2009
EP 2 950 385 12/2015
(Continued)

OTHER PUBLICATIONS

PCT/ISA/210 Search Report issued on PCT/KR2018/005660, pp. 5.
(Continued)

*Primary Examiner* — David E Lotter
(74) *Attorney, Agent, or Firm* — The Farrell Law Firm, P.C.

(57) ABSTRACT

An electronic device according to an embodiment of the disclosure may include housing including a rear cover and a cover glass facing away from the rear cover, an antenna array interposed between the rear cover and the cover glass and including at least one or more antenna units, a printed circuit board (PCB) interposed between the antenna array and the cover glass, and a communication circuit disposed on the PCB and feeding the antenna array. Other various embodiments as understood from the specification are also possible.

13 Claims, 25 Drawing Sheets

(56) References Cited

U.S. PATENT DOCUMENTS

| | | | | |
|---|---|---|---|---|
| 8,224,253 | B2 | 7/2012 | Ofek et al. | |
| 8,860,613 | B2 | 10/2014 | Andrenko | |
| 9,548,544 | B2 | 1/2017 | Watson et al. | |
| 9,799,962 | B2 | 10/2017 | Lee et al. | |
| 10,153,539 | B2 | 12/2018 | Seo et al. | |
| 2003/0146874 | A1 | 8/2003 | Kane et al. | |
| 2004/0196834 | A1 | 10/2004 | Ofek et al. | |
| 2006/0227052 | A1* | 10/2006 | Tavassoli Hozouri | H01Q 9/36 343/700 MS |
| 2011/0222448 | A1 | 9/2011 | Ofek et al. | |
| 2013/0099982 | A1 | 4/2013 | Andrenko | |
| 2014/0112511 | A1 | 4/2014 | Corbin et al. | |
| 2015/0214634 | A1 | 7/2015 | Lee et al. | |
| 2016/0254590 | A1* | 9/2016 | Seo | H01Q 5/364 343/876 |
| 2016/0336646 | A1 | 11/2016 | Baek et al. | |
| 2016/0344093 | A1 | 11/2016 | Tagi et al. | |

FOREIGN PATENT DOCUMENTS

| | | |
|---|---|---|
| JP | 2013090183 | 5/2013 |
| KR | 101107266 | 1/2012 |
| KR | 1020150089509 | 8/2015 |
| KR | 1020160105244 | 9/2016 |
| KR | 1020160132649 | 11/2016 |

OTHER PUBLICATIONS

PCT/ISA/237 Written Opinion issued on PCT/KR2018/005660, pp. 7.

European Search Report dated Jan. 13, 2021 issued in counterpart application No. 18808811.6-1205, 7 pages.

European Search Report dated Mar. 6, 2020 issued in counterpart application No. 18808811.6-1205, 9 pages.

* cited by examiner

ANTENNA ARRAY AND ELECTRONIC DEVICE INCLUDING ANTENNA ARRAY

PRIORITY

This application is a National Phase Entry of PCT International Application No. PCT/KR2018/005660 which was filed on May 17, 2018, and claims priority to Korean Patent Application No. 10-2017-0066626, which was filed on May 30, 2017, the content of each of which is incorporated herein by reference.

TECHNICAL FIELD

Embodiments disclosed of this specification relates to a technology for reducing the size of an antenna array.

BACKGROUND ART

An electronic device, which is equipped with an antenna, such as a smartphone, a wearable device, or the like is widely supplied as mobile communication technologies develop. The electronic device may transmit/receive various kinds of data (e.g., a message, a photo, a video, a music file, a game, or the like) via an antenna.

The electronic device may include a plurality of antennas to efficiently transmit/receive the above-described data. For example, the electronic device may include an antenna array in which a plurality of antennas are arranged in a regular shape. Because an antenna array has an effective isotropically radiated power (EIRP) greater than one antenna, the electronic device may transmit/receive various kinds of data more effectively.

DISCLOSURE

Technical Problem

Because the antenna array includes a plurality of antennas, the antenna array may have an area greater than a single antenna. Furthermore, a plurality of components (e.g., a printed circuit board (PCB), battery, or the like) may be mounted in the electronic device, in addition to the antenna array. Accordingly, the electronic device may not have enough space for mounting the antenna array.

Moreover, the antenna array may be constrained during the production process. For example, the antenna array needs to be arranged in a specific shape, and thus the antenna array may not be implemented in various forms.

Embodiments disclosed in this specification may provide an antenna array and an electronic device including an antenna array for solving the above-described problem and problems brought up in this specification.

Technical Solution

According to an embodiment disclosed in this specification, an electronic device may include a housing including a rear cover and a cover glass facing away from the rear cover, an antenna array interposed between the rear cover and the cover glass and including at least one or more antenna units, a printed circuit board (PCB) interposed between the antenna array and the cover glass, and a communication circuit disposed on the PCB and feeding the antenna array. Each of the antenna units includes a ground layer and at least one or more antenna elements disposed on the ground layer. Each of the antenna elements may include a conductive member extending from the ground layer, a radiator having a specified spaced distance from the conductive member and surrounding a part of the conductive member, and a feed part electrically connecting the radiator to the communication circuit. The communication circuit may be configured to transmit/receive a signal of a specified frequency band through an electrical path formed via the antenna array.

Furthermore, according to an embodiment disclosed in this specification, an antenna structure may include a non-conductive layer including a first surface, a second surface facing away from the first surface, and a side surface surrounding a space between the first surface and the second surface, a ground layer contacting the second surface, and at least one or more antenna elements disposed on the ground layer. Each of the antenna elements may include a conductive member extending from the ground layer to a third surface positioned between the first surface and the second surface, a radiator having a specified spaced distance from the conductive member and surrounding a part of the conductive member on the third surface, and a feed part extending from the radiator to a point between the second surface and the third surface.

According to an embodiment of the disclosure, an electronic device may include housing including a first plate and a second plate facing away from the first plate, a touch screen display exposed through a part of the first plate, a wireless communication circuit mounted on the PCB interposed between the first plate and the second plate transmitting/receiving a signal in a frequency band, which is not less than 20 GHz, and at least one antenna array coupled or connected with the PCB. The at least one antenna array may include at least one or more antenna elements, a first layer in parallel with the second plate and including a first conductive pattern and a second conductive pattern electrically separated from the first conductive pattern, a first conductive via, which extends vertically from the first layer, of which one end is electrically connected to the first conductive pattern, and of which the other end is electrically connected to the wireless the communication circuit, and a second conductive via, which extends vertically from the first layer, of which one end is electrically connected to the second conductive pattern, and of which the other end is electrically connected to the wireless the communication circuit.

Advantageous Effects

According to embodiments disclosed in this specification, it is possible to reduce the size of an antenna array. According to embodiments disclosed in this specification, it is possible to improve the performance of an antenna array.

Besides, a variety of effects directly or indirectly understood through the disclosure may be provided.

MODE FOR INVENTION

Figure 1:
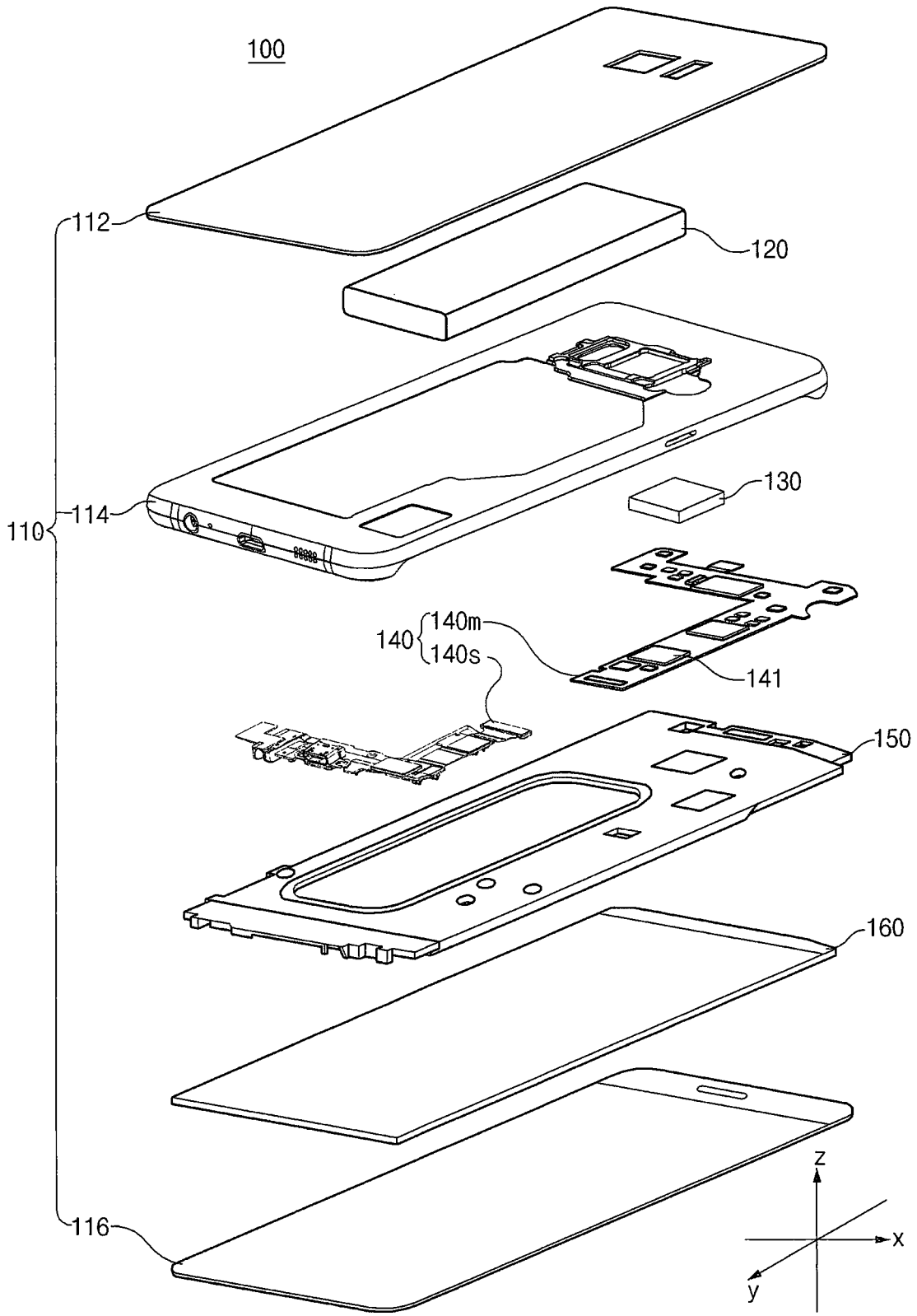
FIG. 1 is an exploded perspective view of an electronic device according to an embodiment.

FIG. 1 is an exploded perspective view of an electronic device according to an embodiment.

Referring to FIG. 1, an electronic device 100 may include housing 110, a battery 120, an antenna array 130, a PCB 140, a support member 150, and a display 160. According to an embodiment, the electronic device 100 may not include some of the components illustrated in FIG. 1 or may further include one or more components not illustrated in FIG. 1. Also, the order in which the components included in the electronic device 100 are stacked may be different from the stacked order illustrated in FIG. 1.

The housing 110 may include a rear cover 112, side housing 114, and a cover glass 116.

The rear cover 112 may form an outer appearance of the electronic device 100. For example, the rear cover 112 may be coupled to the side housing 114 to form the z-direction appearance of the electronic device 100. The rear cover 112 may be integrally implemented with the side housing 114 or may be implemented to be removable by a user. According to an embodiment, the rear cover 112 may be implemented with tempered glass, plastic injection molding material, and/or metal.

The side housing 114 may accommodate each component of the electronic device 100. For example, the side housing 114 may accommodate the battery 120, the PCB 140, and the like. According to an embodiment, the side housing 114 may include an area that is not exposed to the outside of the electronic device 100 and an area that is exposed through an outer side surface of the electronic device 100. For example, the area that is not exposed to the outside of the electronic device 100 may be formed of a plastic injection-molding material, and the area that is exposed through the outer side surface of the electronic device 100 may be formed of a metal material. The exposed area of the outer side surface, which is formed of a metal material, may be also referred to as a "metal bezel". According to an embodiment, at least part of the metal bezel may be utilized as an antenna radiator for radiating the signal of a specified frequency band (e.g., 2.5 GHz band).

The cover glass 116 may transmit a light generated by the display 160. Furthermore, a user may touch the cover glass 116 by using a portion (e.g., a finger) of his/her body to perform a touch (including a contact using an electronic pen). The cover glass 116 may be form of, for example, tempered glass, reinforced plastic, a flexible polymer material, or the like, and may protect the display 160 and each component included in the electronic device 100 from an external shock. According to various embodiments, the cover glass 116 may be also referred to as a "glass window".

The battery 120 may convert chemical energy and electrical energy bidirectionally. For example, the battery 120 may convert chemical energy into electrical energy and may supply the electrical energy to the display 160 and various components or modules mounted on the PCB 140. Alternatively, the battery 120 may convert and store electrical energy supplied from the outside into chemical energy. According to an embodiment, a power management module for managing charging and discharging of the battery 120 may be included in the PCB 140.

The antenna array 130 may be interposed between the side housing 114 and the PCB 140. Although not illustrated, the antenna array 130 may be attached on the rear cover 112 or may be interposed between the rear cover 112 and the side housing 114.

The antenna array 130 may include a plurality of antenna units. In this specification, an antenna unit may refer to a configuration capable of radiating the signal of a specified frequency band (e.g., 28 GHz). The antenna array 130 includes a plurality of antenna units, and thus the antenna array 130 may have EIRP greater than a single antenna unit. In other words, the antenna array 130 may form the beam pattern having a sharper shape in one direction (e.g., z-direction) than a single antenna unit.

For example, the PCB 140 may include a first PCB **140*m* (or a main PCB) and a second PCB 140*s* (or a sub PCB). According to an embodiment, the first PCB 140*m* and the second PCB 140*s* may be interposed between the side housing 114 and the support member 150 and may be electrically connected to each other via a specified connector or a specified wire. According to an embodiment, various electronic components (e.g., a communication circuit 141), elements, printed circuits, and the like may be mounted or arranged on the PCB 140. The PCB 140** may be referred to as a "main board" or "printed board assembly (PBA)" or may be simply referred to as a "PCB".

The communication circuit 141 may be electrically connected to the antenna array 130 via a specified wire (e.g., a flexible printed circuit board (FPCB)). The communication circuit 141 may feed the antenna array 130. The communication circuit 141 may radiate the signal of a specified frequency band (e.g., 28 GHz band) via the electrical path formed through the antenna array 130. In the specification, the "feed" may mean an operation in which the communication circuit 141 applies current to the antenna array 130.

The support member 150 (e.g., bracket) may be coupled with the display 160 and the PCB 140 to support the display 160 and the PCB 140 physically. According to an embodiment, the support member 150 may include a through hole through which a part of an FPCB may pass.

The display 160 may be interposed between the support member 150 and the cover glass 116. Also, the display 160 may be electrically connected to the PCB 140 so as to output content (e.g., a text, an image, a video, an icon, a widget, a symbol, or the like). The display 160 may receive a touch input (e.g., a touch, a gesture, or the like) from a user. A thin film sheet or a plate which is formed of copper (Cu) or graphite may be positioned on a rear surface of the display 160.

In the disclosure, the description given with reference to FIG. 1 may be identically applied to components having the same reference numerals/marks as the components of the electronic device 100 described with reference to FIG. 1.

Figure 2A:
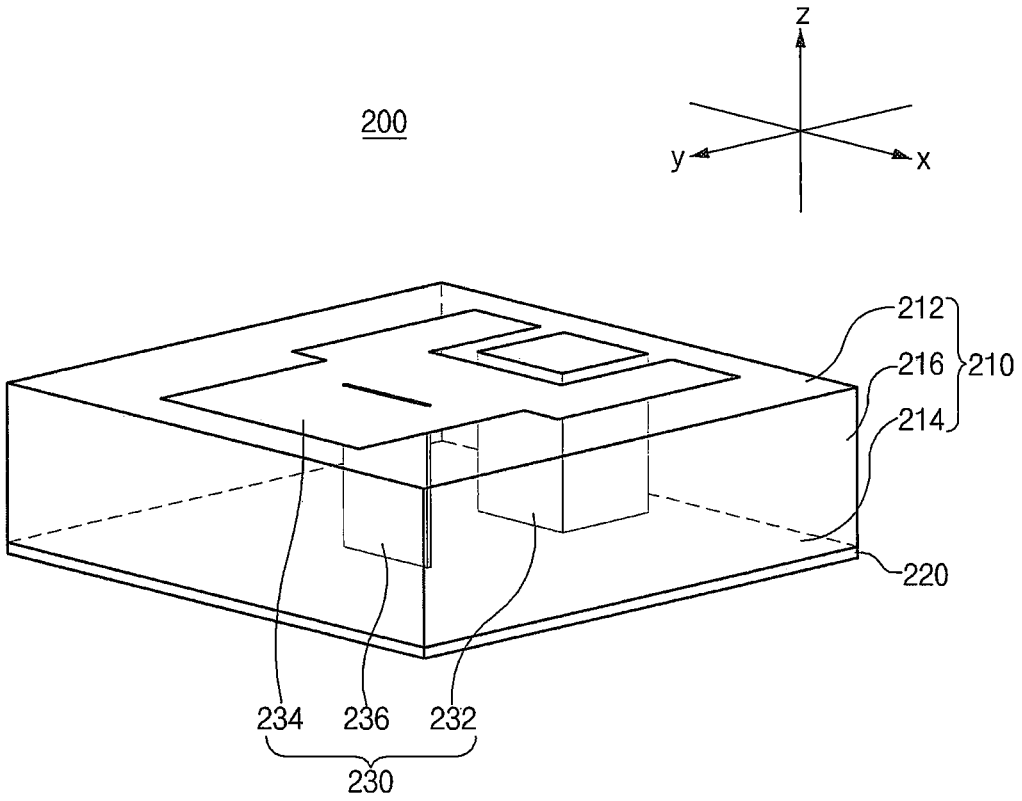
FIG. 2A illustrates an antenna unit, according to an embodiment.

FIG. 2A illustrates an antenna unit, according to an embodiment. An antenna unit 200 illustrated in FIG. 2A may be included in the antenna array 130 illustrated in FIG. 1.

Referring to FIG. 2A, the antenna unit 200 may include a nonconductive layer 210, a ground layer 220, and an antenna element 230.

The nonconductive layer 210 may include a first surface 212, a second surface 214 facing the first surface 212, and a side surface 216 surrounding a space between the first surface 212 and the second surface 214. According to an embodiment, the space may be formed of a nonconductive material (e.g., plastic).

The ground layer 220 may contact the second surface 214. According to an embodiment, the ground layer 220 may be formed of a conductive material (e.g., copper (Cu), Graphite, or the like).

The antenna element 230 may include a conductive member 232, a radiator 234, and a feed part 236.

The conductive member 232 may extend from the ground layer 220 to the first surface 212. Although not illustrated, the conductive member 232 may extend from the ground layer 220 to a point between the first surface 212 and the second surface 214.

According to an embodiment, the conductive member 232 may have the shape of a square pillar. An embodiment in FIG. 2A is exemplified as the conductive member 232 has a square pillar shape. However, the conductive member 232 may have the shape of a circular column.

According to an embodiment, the conductive member 232 may be formed of a conductive material (e.g., copper (Cu), Graphite, or the like). In the specification, the conductive member 232 may be referred to as a "via".

The radiator 234 may have a specified spaced distance with the conductive member 232. Also, the radiator 234 may surround a part of the conductive member 232. For example, when the conductive member 232 has the shape of a square pillar, the radiator 234 may surround the remaining surfaces other than one of the side surfaces 216 of the conductive member 232.

According to an embodiment, the radiator 234 may be implemented with a specified shape on the plane. For example, as illustrated in FIG. 2A, one part of the radiator 234 surrounds the conductive member 232 and the other part may extend in 'y' direction. The shape of the radiator 234 is not limited to the shape illustrated in FIG. 2A. For example, other parts of the radiator 234 may extend in 'x' direction.

The feed part 236 may electrically connect the radiator 234 to the communication circuit (e.g., the communication circuit 141). For example, one end of the feed part 236 may be connected to the radiator 234 and the other end of the feed part 236 may be connected to the communication circuit 141.

Figure 2B:
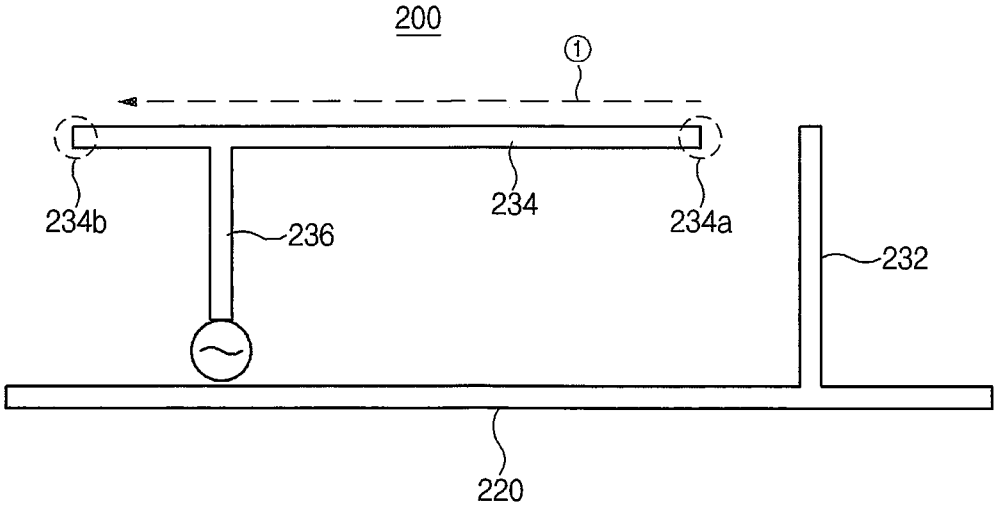
FIG. 2B illustrates a view schematically illustrating an antenna unit, according to an embodiment.

FIG. 2B illustrates a view schematically illustrating an antenna unit, according to an embodiment. FIG. 2B is a view schematically illustrating the antenna unit 200 illustrated in FIG. 2A.

Referring to FIG. 2B, a communication circuit (e.g., the communication circuit 141) may feed the radiator 234 via the feed part 236. When the communication circuit 141 feeds the radiator 234, the voltage difference may occur between one end 234*a* and the other end 234*b* of the radiator 234. For example, the voltage at the one end 234*a* may be greater than the voltage at the other end 234*b*. Because the voltage at the one end 234*a* is greater than the voltage at the other end 234*b*, the current may flow along the first path ①. When the current flows into the radiator 234, the communication circuit 141 may radiate the signal of a specified frequency band (e.g., 28 GHz band) via the electrical path formed through the antenna unit 200.

According to an embodiment, the length (hereinafter, the length of the radiator 234) between the one end 234*a* and the other end 234*b* of the radiator 234 may be inversely proportional to the frequency band at which the communication circuit 141 radiates a signal. For example, as the length of the radiator 234 increases, the communication circuit 141 may radiate the signal of a low frequency band. In contrast, as the length of the radiator 234 decreases, the communication circuit 141 may radiate the signal of a high frequency band. In FIG. 2B, the length of the radiator 234 may be about 2.5 mm; the communication circuit 141 may radiate the signal of about 28 GHz band.

According to an embodiment, the conductive member 232 may block the interference from another antenna unit. For example, a plurality of antenna units may be disposed in the antenna array (e.g., the antenna array 130); each of the antenna units may radiate a signal. In this case, the conductive member 232 may improve signal transmission/reception rate by blocking the interference of another antenna unit. The conductive member 232 may be referred to as a capacitor on an equivalent circuit diagram.

Figure 2C:
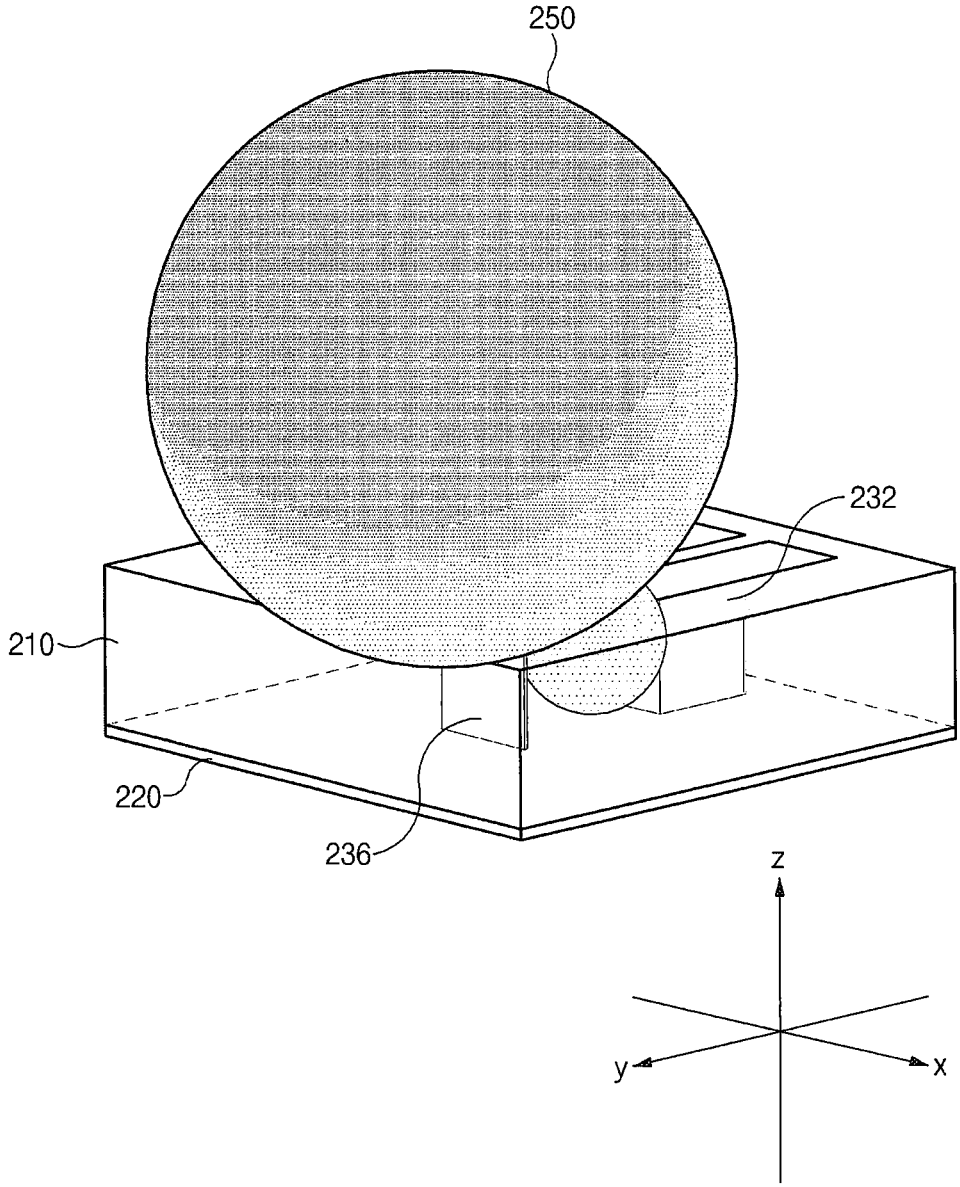
FIG. 2C illustrates a beam pattern, according to an embodiment.

FIG. 2C illustrates a beam pattern, according to an embodiment. A beam pattern 250 illustrated in FIG. 2C illustrates the beam pattern of the antenna unit 200 illustrated in FIG. 2A.

Referring to FIGS. 2B and 2C, because the current flows from the one end 234*a* to the other end 234*b* of the radiator 234, the beam pattern 250 may be inclined obliquely along the first path ① illustrated in FIG. 2B. In other words, the beam pattern 250 may be inclined obliquely in the direction (or the direction between 'y' direction and 'z' direction) of the radiator 234 from the conductive member 232.

In this specification, the beam pattern 250 may indicate the direction and strength in which the antenna unit or the antenna array 130 radiates a signal. In FIG. 2C, because the beam pattern 250 is inclined between 'y' direction and 'z' direction, the antenna unit 200 may radiate the signal of high strength between 'y' direction and 'z' direction.

According to an embodiment, unlike the example illustrated in FIG. 2C, the direction in which the beam pattern 250 faces may be 'z' direction. In this case, the antenna unit 200 may radiate the signal of high strength in 'z' direction.

Figure 3A:
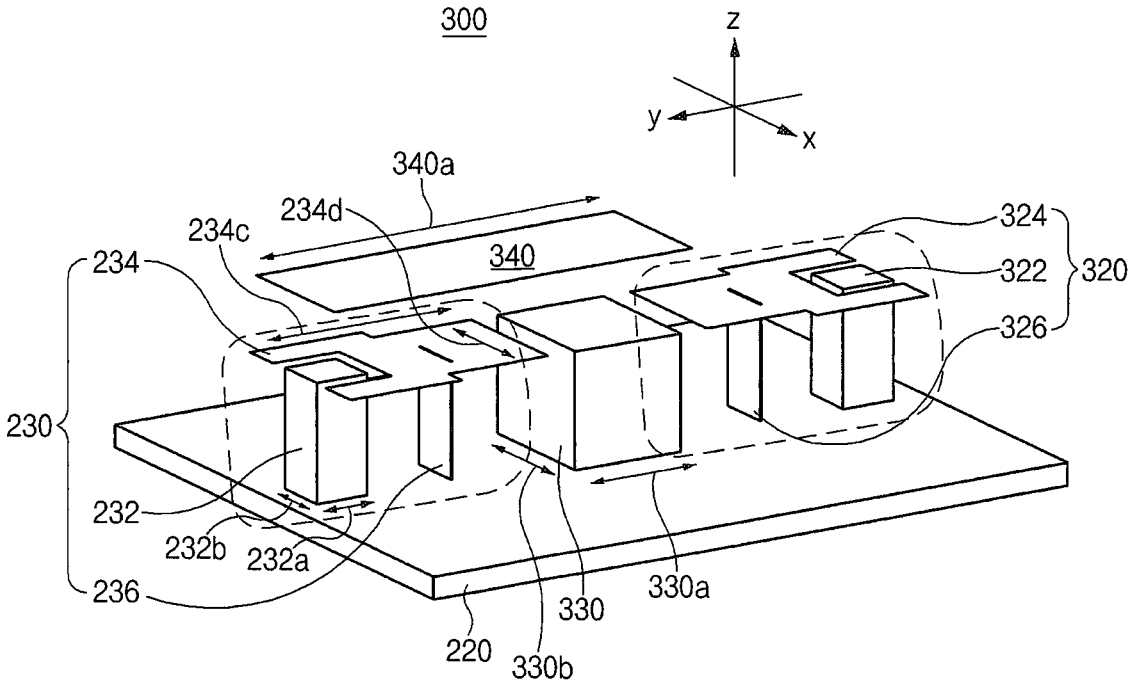
FIG. 3A illustrates an antenna unit, according to another embodiment

FIG. 3A illustrates an antenna unit, according to another embodiment. An antenna unit 300 illustrated in FIG. 3A may be included in the antenna array 130 illustrated in FIG. 1. Furthermore, the antenna unit 300 illustrated in FIG. 3A may indicate the antenna unit 300 in which a part of components is added to the antenna unit 200 illustrated in FIG. 2A.

Referring to FIG. 3A, the antenna unit 300 may include a first antenna element 230, a second antenna element 320, a central member 330, and a central radiator 340. Unless otherwise specified, the description about the antenna element 230 in FIG. 2A may be applied to the first antenna element 230 and the second antenna element 320. That is, the first antenna element 230 may include the conductive member 232, the radiator 234, and the feed part 236. That is, the second antenna element 320 may include a conductive member 322, a radiator 324, and a feed part 326.

The central member 330 may be interposed between the first antenna element 230 and the second antenna element 320. For example, as illustrated in FIG. 3A, the central member 330 may be interposed between the first radiator 234 and the second radiator 324. In this case, the first radiator 234 and the second radiator 324 may have a symmetrical structure with respect to the central member 330. Although not illustrated, the central member 330 may be interposed between the first conductive member 232 and the second conductive member 322. In this case, the first radiator 234 may face the 'y' direction with respect to the first feed part 236; the second radiator 324 may face the '−y' direction with respect to the second feed part 326.

According to an embodiment, the size of the central member 330 may be greater than the size of the first conductive member 232 (or the second conductive member 322). For example, as illustrated in FIG. 3A, when the central member 330 and the first conductive member 232 have the shapes of a square pillar, a transverse length 330*a* of the central member 330 may be longer than a transverse length 232*a* of the first conductive member 232. Also, a longitudinal length 330*b* of the central member 330 may be longer than a longitudinal length 232*b* of the first conductive member 232. Although not illustrated, when the central member 330 and the first conductive member 232 have the shape of a circular column, the diameter of the central member 330 may be longer than the diameter of the first conductive member 232.

According to another embodiment, the longitudinal length 330*b* of the central member 330 may be longer than a longitudinal length 234*d* of the first radiator 234 (or the second radiator 324).

The central radiator 340 may be positioned in 'z' direction with respect to the central member 330. That is, the central radiator 340 may be disposed on a plane located between the central member 330 and the rear cover 112. The central radiator 340 may extend from the first point to the second point on the plane. At this time, the first point may be any point in the region corresponding to the first radiator 234. The second point may be any point in the region corresponding to the second radiator 324. According to an embodiment, the central radiator 340 may be attached to the rear cover 112 through an adhesive material.

According to an embodiment, a length 340*a* of the central radiator 340 may be longer than a length 234*c* of the first radiator 234 (or the second radiator 324). For example, when the length 340*a* of the central radiator 340 is about 5 mm, the length 234*c* of the first radiator 234 may be about 2.5 mm.

Figure 3B:
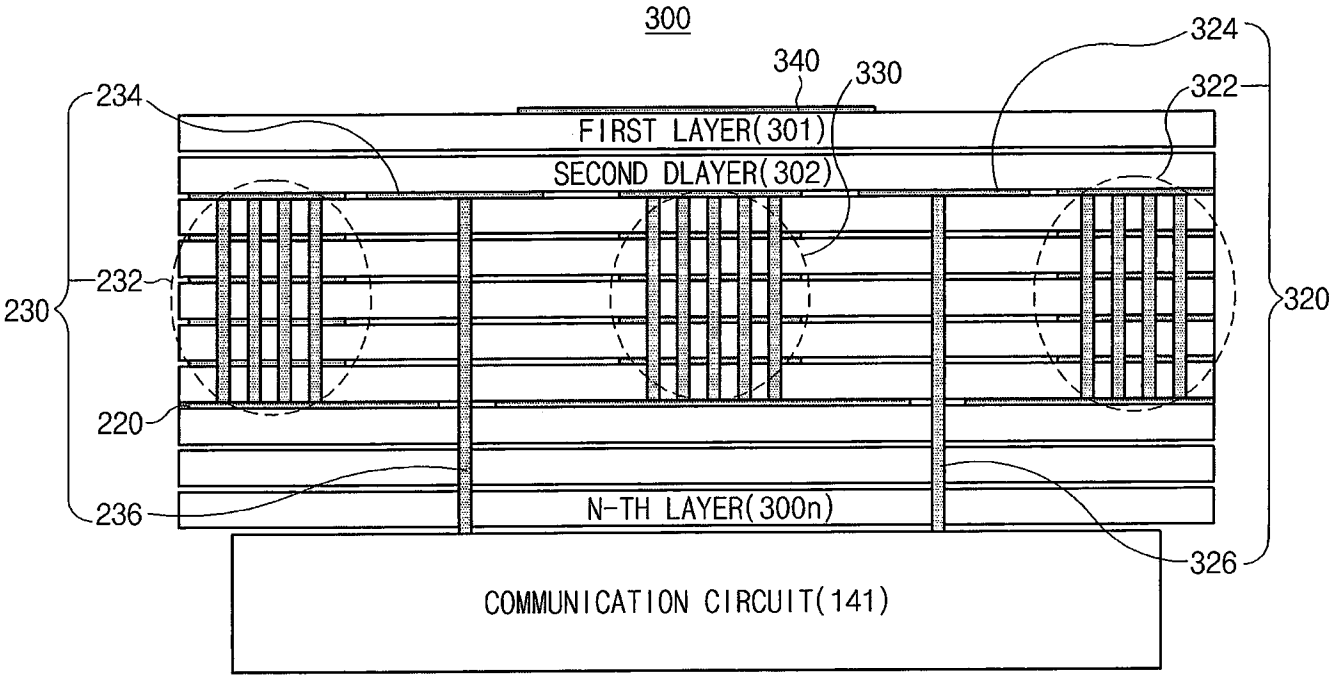
FIG. 3B is a sectional view of an antenna unit, according to another embodiment.

FIG. 3B is a sectional view of an antenna unit, according to another embodiment. FIG. 3B illustrates a sectional view of the antenna unit 300 illustrated in FIG. 3A.

Referring to FIG. 3B, the antenna unit 300 may be composed of a plurality of layers. For example, the antenna unit 300 may include a first layer 301, a second layer 302, . . . , and an n-th layer 300*n*. The first layer 301, the second layer 302, . . . , and the n-th layer 300*n* may be formed of a nonconductive material (e.g. plastic).

According to an embodiment, the first antenna element 230, the second antenna element 320, the central member 330, and the ground layer 220 may be interposed between the first layer 301 and the n-th layer 300*n*. In the meantime, the central radiator 340 may be disposed on the first layer 301 and the communication circuit 141 may be disposed under the n-th layer 300*n*.

According to an embodiment, the first feed part 236 may extend from the first radiator 234 to be electrically connected to the communication circuit 141. At least one or more openings may be formed on the ground layer 220 through which the first feed part 236 is capable of passing. The first feed part 236 may be electrically connected to the communication circuit 141 through one of the openings. Furthermore, the second feed part 326 extends from the second radiator to be electrically connected to the communication circuit 141 through one of the openings.

According to an embodiment, the antenna unit 300 may not include some of the components illustrated in FIG. 3B or may further include any other component not illustrated in FIG. 3B. Also, the order in which the components included in the antenna unit 300 are stacked may be different from the stacked order illustrated in FIG. 3B.

Figure 3C:
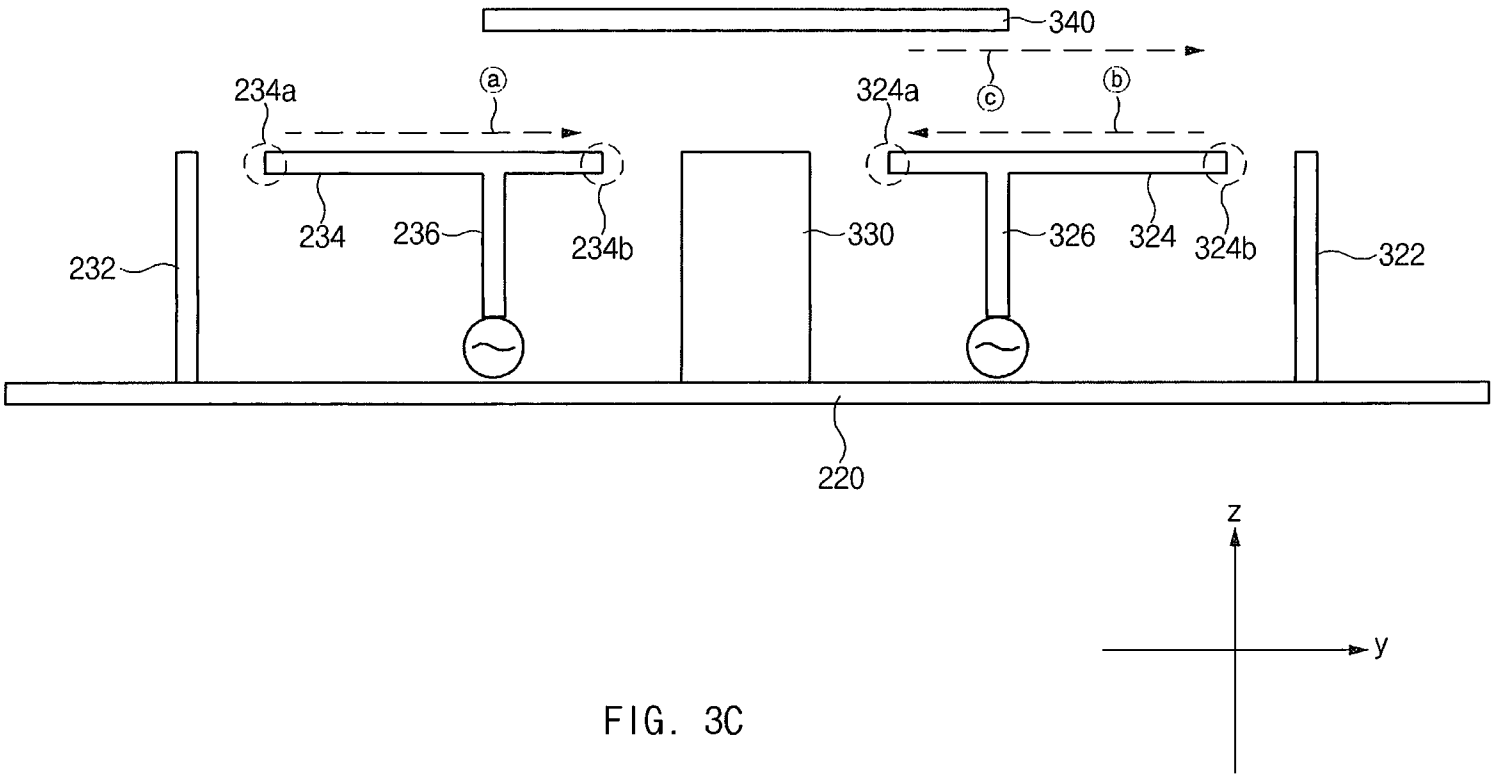
FIG. 3C illustrates a view schematically illustrating an antenna unit, according to another embodiment.

FIG. 3C illustrates a view schematically illustrating an antenna unit, according to another embodiment. FIG. 3C is a view schematically illustrating the antenna unit 300 illustrated in FIG. 3A.

Referring to FIG. 3C, the communication circuit 141 may separately feed the first radiator 234 and the second radiator 324 through the feed parts 236 and 326. For example, the communication circuit 141 may feed power such that the phase of the current applied to the first radiator 234 is the same as the phase of the current applied to the second radiator 324. For another example, the communication circuit 141 may feed the power such that the phase difference between the current applied to the first radiator 234 and the current applied to the second radiator 324 has a specified value.

Firstly, when it is described that the communication circuit 141 feeds the power such that the phase of the current applied to the first radiator 234 is substantially the same as the phase of the current applied to the second radiator 324, the communication circuit 141 may feed a first signal (e.g., a current having a first phase) to the first radiator 234 and may feed a second signal (e.g., a current having a second phase) to the second radiator 324. In this case, the phase difference between the first phase and the second phase may be, for example, 0°.

When the current having the first phase is supplied to the first radiator 234, a voltage difference may occur between the one end 234*a* and the other end 234*b* of the first radiator 234. For example, the voltage at the one end 234*a* may be greater than the voltage at the other end 234*b*. Because the voltage at the one end 234*a* is greater than the voltage at the other end 234*b*, the current may flow along 'a' path ⓐ. In this case, the voltage less than the voltage of the one end 234*a* may be applied to the conductive member 232.

When the current having the second phase is supplied to the second radiator 324, a voltage difference may occur between one end 324*a* and the other end 324*b* of the second radiator 324. For example, the voltage at the one end 324*a* may be less than the voltage at the other end 324*b*. Because the voltage at the one end 324*a* is less than the voltage at the other end 324*b*, the current may flow along 'b' path ⓑ. In this case, the voltage less than the voltage of the other end 234*b* may be applied to the conductive member 322.

Because the direction of current flowing into the first radiator 234 is opposite to the direction of current flowing into the second radiator 324, the direction of the beam pattern formed by the first radiator 234 may be opposite to the direction of the beam pattern formed by the second radiator 324. Accordingly, in the embodiment, the beam pattern of the antenna unit 300 may be canceled between the central member 330 and the rear cover (e.g., the rear cover 112 of FIG. 1).

In another embodiment, when it is described that the communication circuit 141 feeds the power such that the phase difference between the current applied to the first radiator 234 and the current applied to the second radiator 324 has a specified value, the communication circuit 141 may feed a third signal (e.g., a current having a third phase) to the first radiator 234 and may feed a fourth signal (e.g., a current having a fourth phase) to the second radiator 324. In this case, the third signal and the fourth signal may be inverted (e.g., the phase difference of 180°) to each other.

When the current having the first phase is supplied to the first radiator 234, a voltage difference may occur between the one end 234*a* and the other end 234*b* of the first radiator 234. For example, the voltage at the one end 234*a* may be greater than the voltage at the other end 234*b*. Because the voltage at the one end 234*a* is greater than the voltage at the other end 234*b*, the current may flow along 'a' path ⓐ. In this case, the voltage less than the voltage of the one end 234*a* may be applied to the conductive member 232.

When the current having the second phase (e.g., the inversion of the first phase) is supplied to the second radiator 324, a voltage difference may occur between the one end 324*a* and the other end 324*b* of the second radiator 324. For example, the voltage at the one end 324*a* may be greater than the voltage at the other end 324*b*. Because the voltage at the one end 324*a* is greater than the voltage at the other end 324*b*, the current may flow along 'c' path ⓒ. In this case, the voltage greater than the voltage of the other end 324*b* may be applied to the conductive member 322.

Because the direction of current flowing into the first radiator 234 is substantially the same as the direction of current flowing into the second radiator 324, the direction of the beam pattern formed by the first radiator 234 may be substantially the same as the direction of the beam pattern formed by the second radiator 324. Accordingly, when the communication circuit 141 feeds power to have a specified phase difference, the beam pattern of the antenna unit 300 may face the 'z' direction.

Figure 4A:
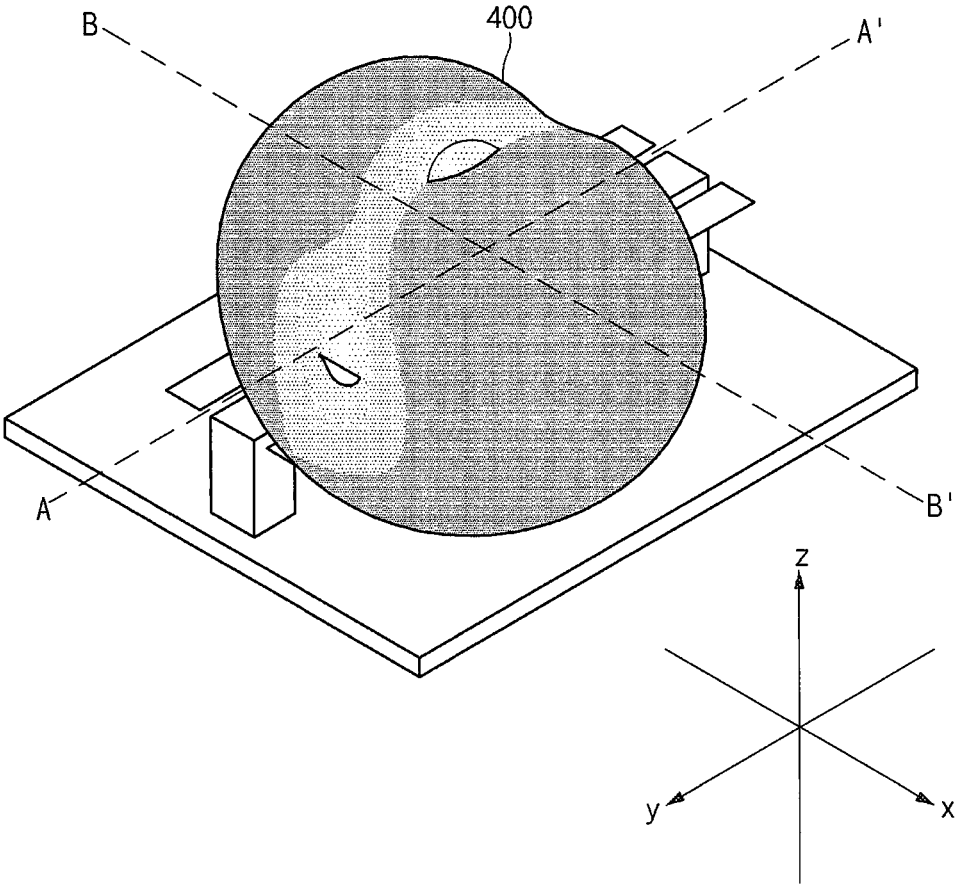
FIG. 4A illustrates a beam pattern, according to another embodiment.
Figure 4B:
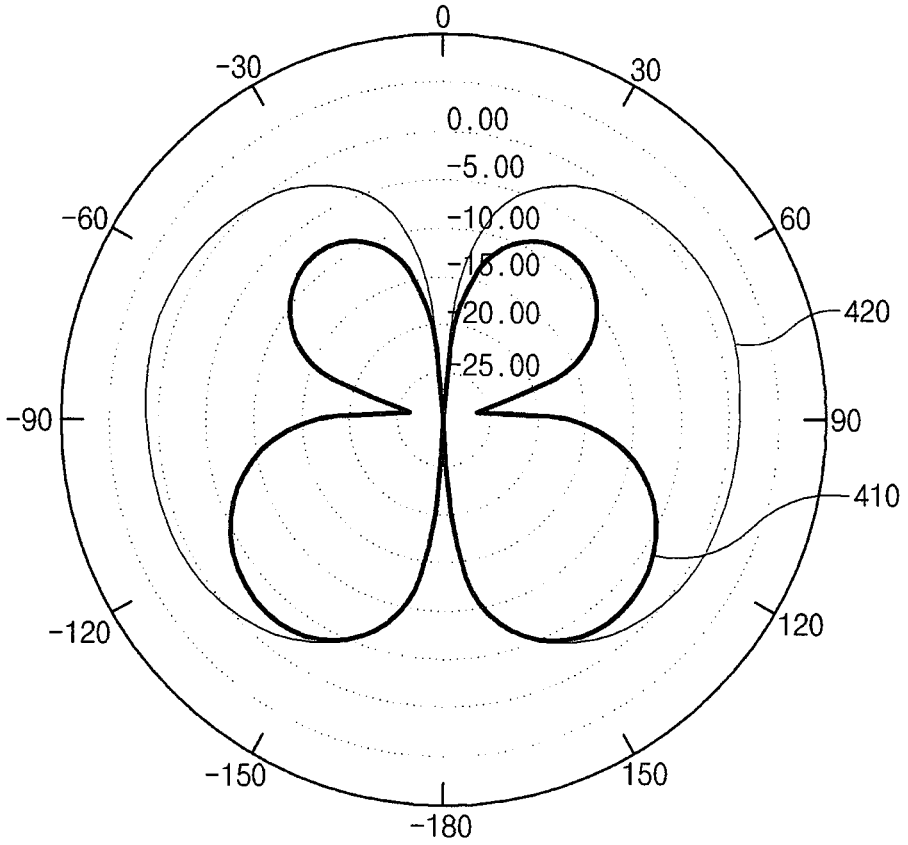
FIG. 4B illustrates a sectional view of a beam pattern, according to an embodiment.
Figure 4C:
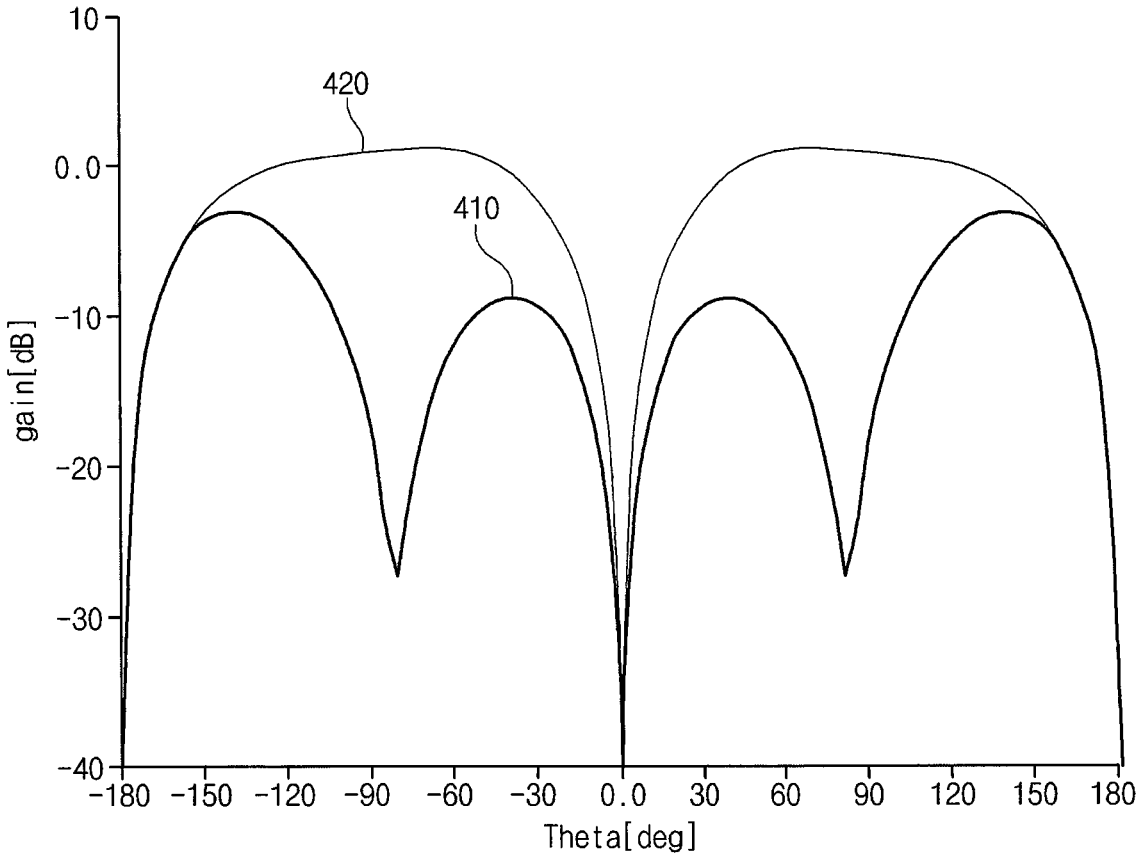
FIG. 4C illustrates a gain of an antenna unit, according to an embodiment.

FIG. 4A illustrates a beam pattern, according to another embodiment. A beam pattern 400 illustrated in FIG. 4A illustrates a beam pattern in the case where a communication circuit (e.g., the communication circuit 141 of FIG. 1) feeds power such that the phase of the current applied to the first radiator 234 and the phase of the current applied to the second radiator 324 have substantially the same value. FIG. 4B illustrates a sectional view of a beam pattern, according to an embodiment. FIG. 4B illustrates a sectional view of a beam pattern 400 illustrated in FIG. 4A. FIG. 4C illustrates a gain of an antenna unit, according to an embodiment. FIG. 4C illustrates a view obtained by unfolding the cross-sectional view of FIG. 4B in the shape of a plan view.

Hereinafter, for convenience of description, it is assumed that the upper surface (the face opposite to the face where the central member 330 contacts the ground layer 220) of the central member 330 is positioned at the center of the beam pattern 400. Moreover, the "angle" to be described later may refer to a slope between the z-axis and a straight line from the center to a point on the surface of the beam pattern 400

Referring to FIG. 4A, the beam pattern 400 may have the concave hole in 'z' direction, '−z' direction, 'y' direction, and '−y' direction with respect to the center. In addition, the beam pattern 400 may have a convex shape in the 'x' direction and the '−x' direction with respect to the center. Accordingly, when the communication circuit 141 feeds power to have substantially the same phase, the antenna unit 300 may radiate the signal of high strength in the 'x' direction and the '−x' direction. The antenna unit 300 may radiate the signal of low strength in 'z' direction, '−z' direction, 'y' direction, and '−y' direction.

Referring to FIGS. 4B and 4C, a graph 410 indicates A-A' cross section of the beam pattern 400 illustrated in FIG. 4A and a graph 420 indicates B-B' cross section of the beam pattern 400 illustrated in FIG. 4A. Referring to the graph 410, it may be understood that the gain gradually increases and then decreases until the angle is from 0° to about 80° (or from 0° to about −80°). Furthermore, it may be understood that the gain gradually increases again and then decreases until the angle is from 80° to about 180° (or from −80° to about −180°). That is, the antenna unit 300 may radiate the signal of low strength in 'z' direction, '−z' direction, 'y' direction, and '−y' direction. However, the antenna unit 300 may radiate the signal of high strength between 'z' direction, (or '−z' direction) and 'y' direction (or '−y' direction).

Referring to the graph 420, it may be understood that the gain gradually increases until the angle is from 0° to about 90° (or from 0° to about −90°). Moreover, it may be understood that the gain gradually decreases until the angle is from 90° to about 180° (or from −90° to about −180°). That is, the antenna unit 300 may radiate the signal of low strength in 'z' direction and '−z' direction. However, the antenna unit 300 may radiate the signal of high strength between 'z' direction, (or '−z' direction) and 'x' direction (or '−x' direction).

Figure 5A:
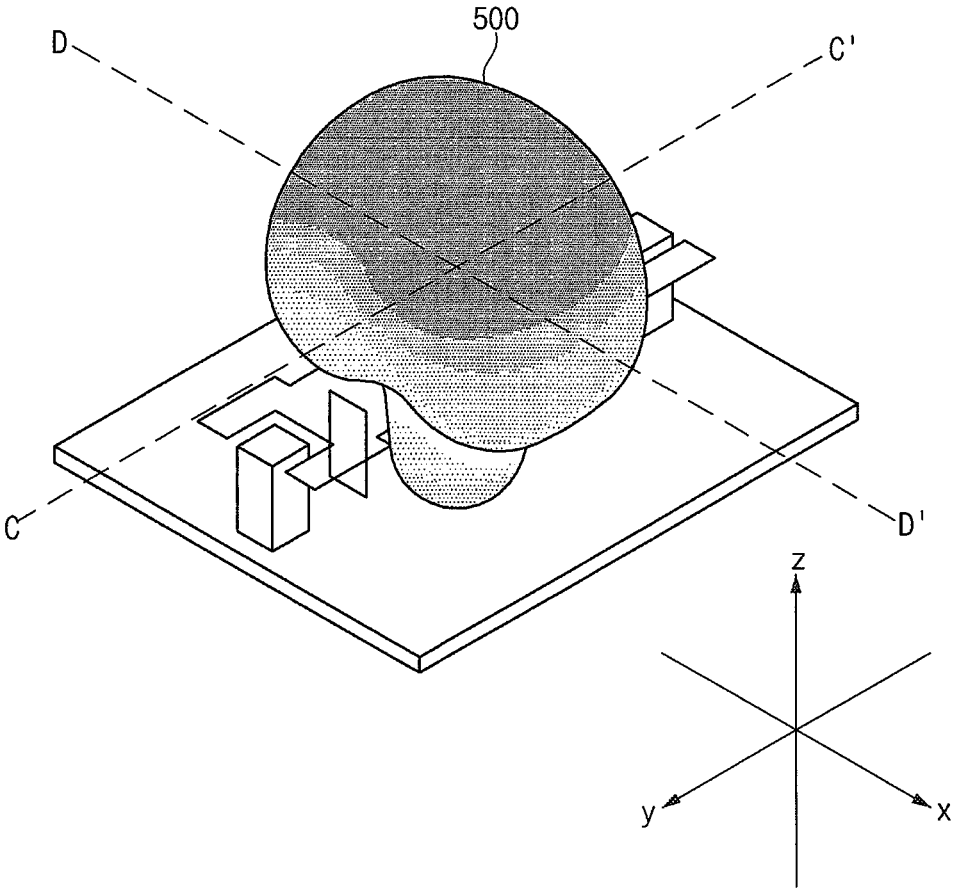
FIG. 5A illustrates a beam pattern, according to still another embodiment.
Figure 5B:
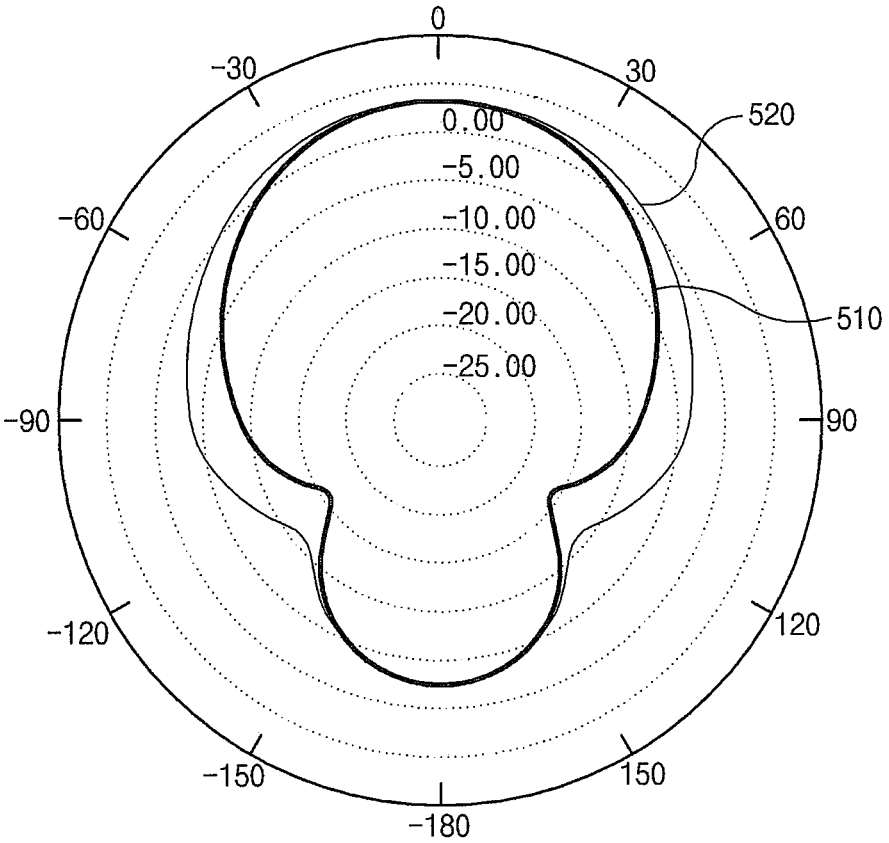
FIG. 5B illustrates a sectional view of a beam pattern, according to another embodiment.
Figure 5C:
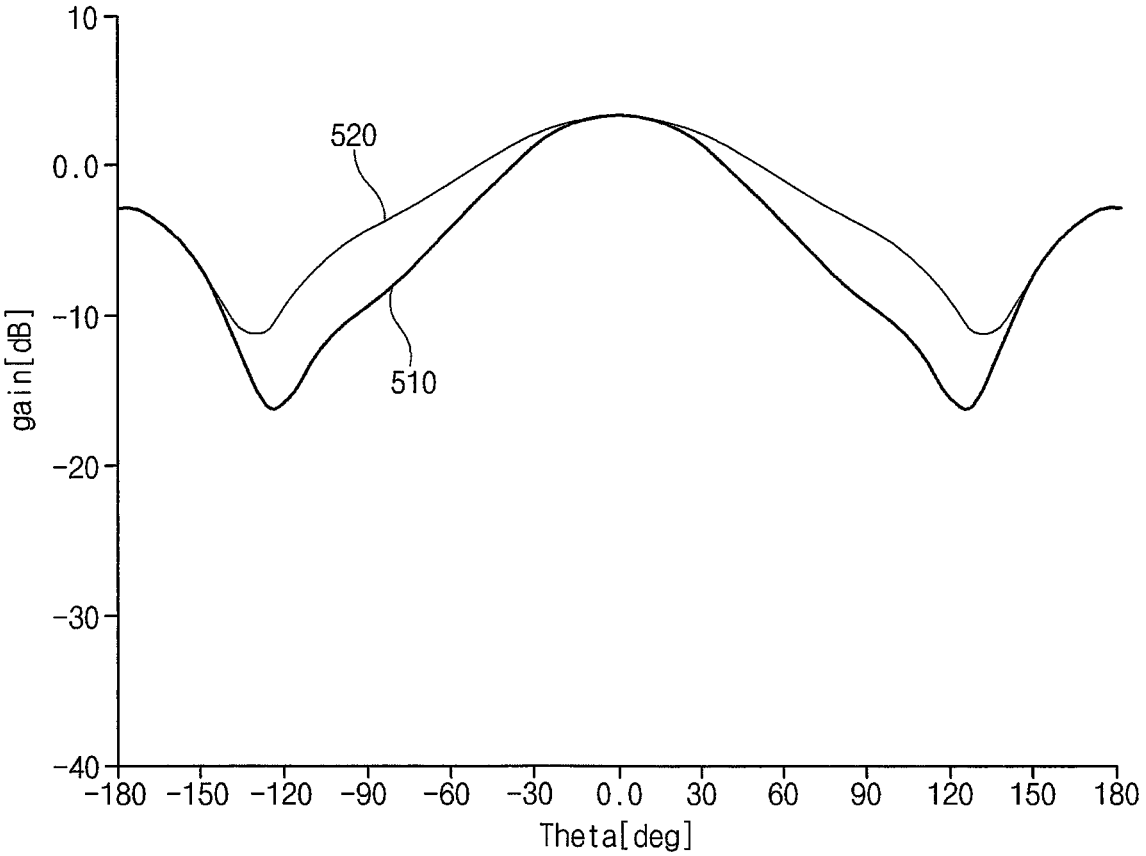
FIG. 5C illustrates a gain of an antenna unit, according to another embodiment.

FIG. 5A illustrates a beam pattern, according to still another embodiment. A beam pattern 500 illustrated in FIG. 5A illustrates a beam pattern in the case where a communication circuit (e.g., the communication circuit 141 of FIG. 1) feeds power such that the phases of the current applied to the first radiator 234 and the current applied to the second radiator 324 has a specified value (e.g., 180°). FIG. 5B illustrates a sectional view of a beam pattern, according to another embodiment. FIG. 5B illustrates a sectional view of the beam pattern 500 illustrated in FIG. 5A. FIG. 5C illustrates a gain of an antenna unit, according to another embodiment. FIG. 5C illustrates a view obtained by unfolding the cross-sectional view of FIG. 5B in the shape of a plan view.

Referring to FIG. 5A, the beam pattern 500 may have a convex shape in 'z' direction with respect to the center. Also, the beam pattern 500 may have a convex shape in '−z' direction with respect to the center. In this case, the portion facing the '−z' direction may be smaller than the portion facing the 'z' direction. Accordingly, when the communication circuit 141 feeds power to have the specified phase difference, the antenna unit 300 may radiate the signal of high strength in the 'z' direction. On the other hand, the antenna unit 300 may radiate the signal of low strength in '−z' direction.

Referring to FIGS. 5B and 5C, a graph 510 indicates C-C' cross section of the beam pattern 500 illustrated in FIG. 5A and a graph 520 indicates D-D' cross section of the beam pattern 500 illustrated in FIG. 5A. In each of the graph 510 and the graph 520, it may be understood that the gain gradually decreases until the angle is from 0° to about 120° (or from 0° to about −120°). On the other hand, it may be understood that the gain gradually increases until the angle is from 120° to about 180° (or from −120° to about −180°). That is, the antenna unit 300 may gradually radiate the signal of low strength from 'z' direction to 'x' direction (or 'y' direction). Especially, when the angle is about 120°, the antenna unit 300 may radiate the signal of low strength. Furthermore, when the angle is not less than about 120°, the antenna unit 300 may gradually radiate the signal of high strength.

According to an embodiment, the antenna unit 300 may radiate the signals of strengths different depending on the cross section. For example, comparing the graph 510 with the graph 520, it may be understood that the gain of the graph 520 is greater than the gain of the graph 510 in the range of 0° to about 120°. That is, the antenna unit 300 may radiate the signal of higher strength in 'x-z' plane than in 'y-z' plane.

Figure 6A:
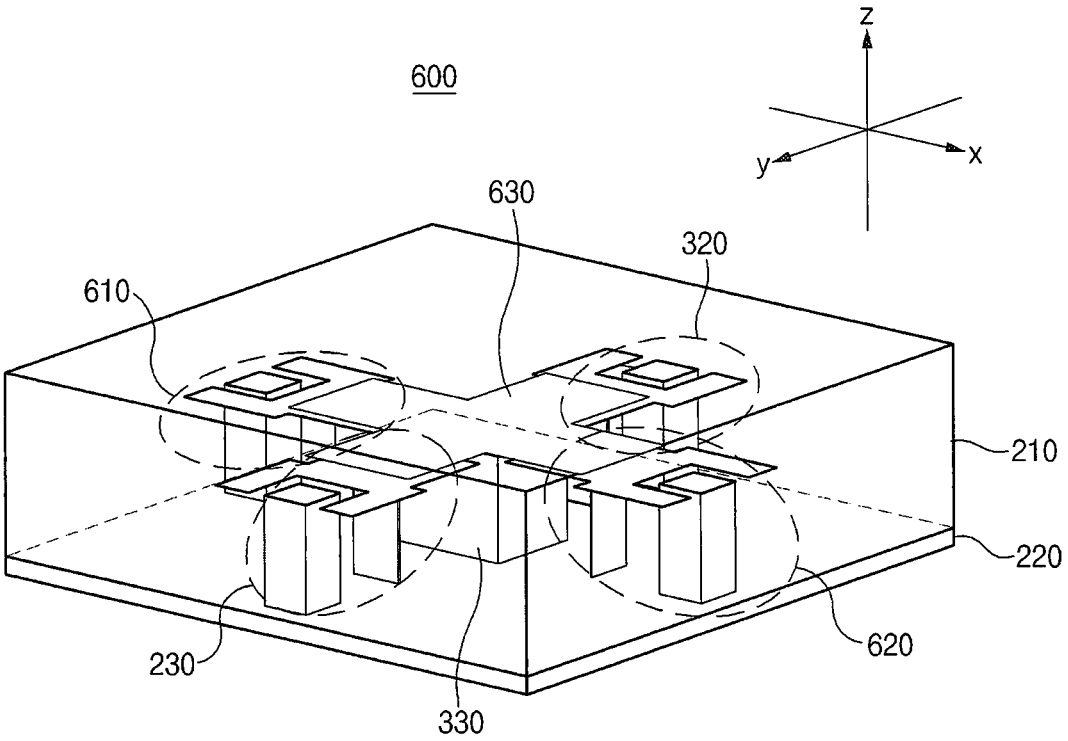
FIG. 6A illustrates an antenna unit, according to another embodiment

FIG. 6A illustrates an antenna unit, according to another embodiment. An antenna unit 600 illustrated in FIG. 6A may be included in the antenna array 130 illustrated in

FIG. 1.

Referring to FIG. 6A, the antenna unit 600 may include the first antenna element 230, the second antenna element 320, a third antenna element 610, a fourth antenna element 620, the central member 330, and a central radiator 630. Unless otherwise specified, the description about the antenna element 230 in FIG. 2A may be applied to the third antenna element 610 and the fourth antenna element 620. That is, each of the third antenna element 610 and the fourth antenna element 620 may include a conductive member, a radiator, and a feed part.

The central member 330 may be disposed among the first antenna element 230 to the fourth antenna element 620. For example, as illustrated in FIG. 6A, the central member 330 may be interposed between the first antenna element 230 and the second antenna element 320, and between the third antenna element 610 and the fourth antenna element 620. In this case, the first antenna element 230 and the second antenna element 320 may have a symmetrical structure with respect to the central member 330. The third antenna element 610 and the fourth antenna element 620 may also have a symmetrical structure with respect to the central member 330.

The central radiator 630 may be positioned in 'z' direction with respect to the central member 330. That is, the central radiator 630 may be disposed on a plane located between the central member 330 and the rear cover 112. One part of the central radiator 630 may extend from a first point to a second point on the plane and the other part of the central radiator 630 may extend from a third point to a fourth point. At this time, the first point may be any point of a region corresponding to the first antenna element 230 and the second point may be any point of a region corresponding to the second antenna element 320. The third point may be any point of a region corresponding to the third antenna element 610 and the fourth point may be any point of a region corresponding to the fourth antenna element 620.

Figure 6B:
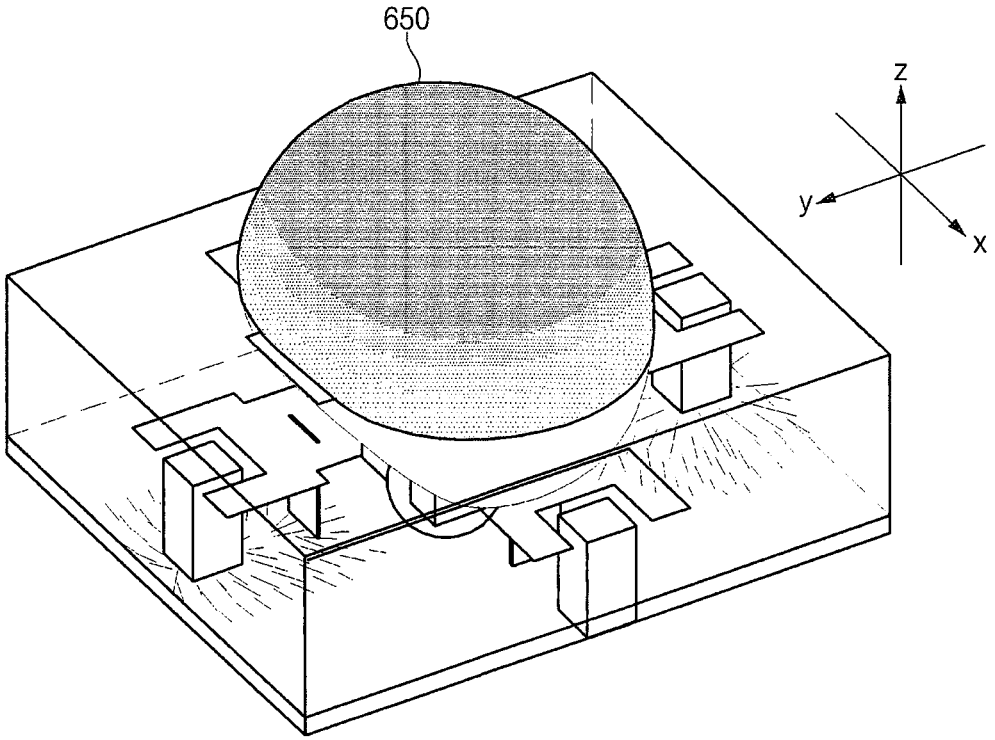
FIG. 6B is a beam pattern of an antenna unit, according to still another embodiment.

FIG. 6B is a beam pattern of an antenna unit, according to still another embodiment. A beam pattern 650 illustrated in FIG. 6B illustrates the beam pattern of the antenna unit 600 illustrated in FIG. 6A.

According to an embodiment, a communication circuit (e.g., the communication circuit 141 of FIG. 1) may feed the signal (e.g., the current having a phase difference of 180°) having a first phase difference to the first antenna element 230 and the second antenna element 320. Furthermore, the communication circuit may feed the signal (e.g., the current having a phase difference of 180°) having a second phase difference to the third antenna element 610 and the fourth antenna element 620.

When each of the first antenna element 230 to the fourth antenna element 620 is fed, the beam pattern 650 may have a convex shape in 'z' direction with respect to the center of the beam pattern 650. Also, the beam pattern 650 may have a convex shape in '−z' direction with respect to the center. In this case, the portion facing the '−z' direction may be smaller than the portion facing the 'z' direction. Accordingly, the antenna unit 600 may radiate the signal of high strength in 'z' direction. On the other hand, the antenna unit 600 may radiate the signal of low strength in '−z' direction.

According to an embodiment, the antenna unit 600 illustrated in FIG. 6A may radiate a signal of higher strength at more various angles than the antenna unit 300 illustrated in FIG. 3A. For example, in the case of the antenna unit 300, the strength of the signal radiated by the antenna unit 300 at the angle of about 120° may be weak. However, even when the angle is about 120°, the antenna unit 600 may radiate the signal of higher strength than the antenna unit 300.

When the beam pattern 500 illustrated in FIG. 5A is compared with the beam pattern 650 illustrated in FIG. 6B, the beam pattern 650 may have a slightly rounder shape than the beam pattern 500. For example, in the case of the beam pattern 650, a part facing '−z' direction may have a slightly rounder shape than the beam pattern 500. Accordingly, when the beam pattern 650 is compared with the beam pattern 500, it may be understood that the antenna unit 600 may radiate the signal of higher strength at various angles than the antenna unit 300.

Figure 7:
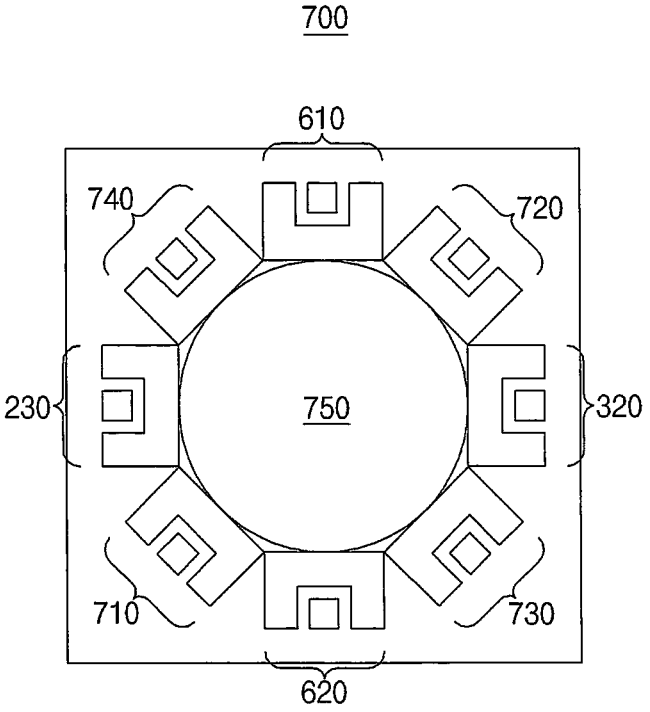
FIG. 7 illustrates an antenna unit, according to still another embodiment.

FIG. 7 illustrates an antenna unit, according to still another embodiment. An antenna unit 700 illustrated in FIG. 7 may be included in the antenna array 130 illustrated in FIG. 1.

Referring to FIG. 7, the antenna unit 700 may include the first antenna element 230, the second antenna element 320, the third antenna element 610, the fourth antenna element 620, a fifth antenna element 710, a sixth antenna element 720, a seventh antenna element 730, an eighth antenna element 740, a central member (e.g., the central member 330 of FIG. 3), and a central radiator 750. Unless otherwise specified, the description about the antenna element 230 in FIG. 2A may be applied to the fifth antenna element 710 to the eighth antenna element 740. That is, each of the fifth antenna element 710 to the eighth antenna element 740 may include a conductive member, a radiator, and a feed part.

Although not illustrated in FIG. 7, the central member 330 may be disposed among the first antenna element 230 to the eighth antenna element 740. For example, the first antenna element 230 to the eighth antenna element 740 may surround the central member 330.

The central radiator 750 may be disposed in the direction, in which the rear cover 112 is disposed, with respect to the central member 330. That is, the central radiator 750 may be disposed on a plane located between the central member 330 and the rear cover 112. According to an embodiment, when viewed from the rear cover 112, the central radiator 750 may overlap with at least part of the antenna elements 230, 320, 610, 620, 710, 720, 730, and 740. For example, in a state where radiators included in each of the antenna elements 230, 320, 610, 620, 710, 720, 730, and 740 are disposed to face the central member 330, the central radiator 750 may be spaced vertically from each of the radiators. In addition, when viewed from the rear cover 112, the central radiator 750 may overlap with a part of the radiators.

Figure 8:
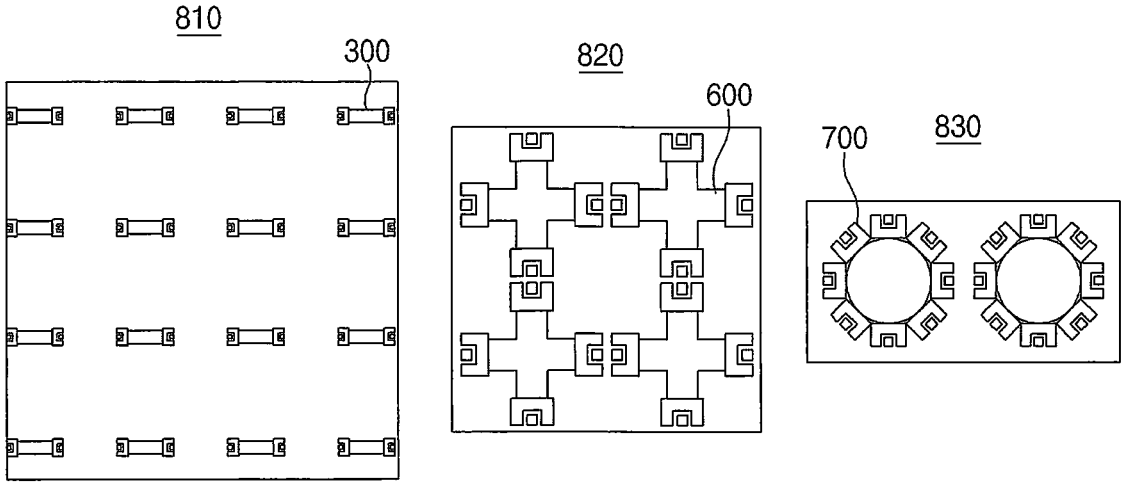
FIG. 8 illustrates an antenna array, according to various embodiments.

FIG. 8 illustrates an antenna array, according to various embodiments.

Referring to FIG. 8, an antenna array (e.g., the antenna array 130 of FIG. 1) may include at least one or more antenna units. For example, the antenna array 130 may include the antenna unit 200 (illustrated in FIG. 2A); the antenna array 130 may include the antenna unit 300 (illustrated in FIG. 3A). Furthermore, the antenna array 130 may include the antenna unit 600 (illustrated in FIG. 6A); the antenna array 130 may include the antenna unit 700 (illustrated in FIG. 7). A first antenna array 810 illustrated in FIG. 8 may correspond to the case where the antenna units 300 are included in the antenna array 130; a second antenna array 820 may correspond to the case where the antenna units 600 are included in the antenna array 130; a third antenna array 830 may correspond to the case where the antenna units 700 are included in the antenna array 130.

According to an embodiment, the number of antenna elements included per unit area may be different depending on types of antenna units included in the antenna array 130. For example, when the first antenna array 810 is compared with the second antenna array 820, the first antenna array 810 may include the 16 antenna units 300. Because each of the antenna units 300 includes two antenna elements, the first antenna array 810 may include 32 antenna elements. The second antenna array 820 may include the four antenna units 600. Because each of the antenna units 600 includes four antenna elements, the second antenna array 820 may include 16 antenna elements.

In the meantime, the area of the first antenna array 810 may be, for example, about 416.16 $mm^2$ and the area of the second antenna array 820 may be, for example, about 144 $mm^2$. Accordingly, for example, in the case of the first antenna array 810, the number of antenna elements included in about 1 $mm^2$ is about 0.077; for example, in the case of the second antenna array 820, the number of antenna elements included in about 1 $mm^2$ is about 0.111.

When the second antenna array 820 is compared with the third antenna array 830, as described above, the second antenna array 820 may include 16 antenna elements. The third antenna array 830 may include the two antenna units 700. Because each of the antenna units 700 includes eight antenna elements, the third antenna array 830 may include 16 antenna elements. In the meantime, the area of the third antenna array 830 may be, for example, about 72 $mm^2$. Accordingly, in the case of the third antenna array 830, the number of antenna elements included in about 1 $mm^2$ may be, for example, about 0.222.

According to an embodiment of the disclosure, the second antenna array 820 may include the greater number of antenna elements per unit area than the first antenna array 810; the third antenna array 830 may include the greater number of antenna elements per unit area than the second antenna array 820. Accordingly, the signal transmission/reception rate of the second antenna array 820 may be better than that of the first antenna array 810; the signal transmission/reception rate of the third antenna array 830 may be better than that of the second antenna array 820.

According to an embodiment, each of the antenna arrays 810, 820, and 830 includes a plurality of columns and a plurality of rows; the antenna elements 300, 600, and 700 may be disposed at points where the rows and the columns intersect. For example, the first antenna array 810 may include four columns and four rows, and the antenna element 300 may be disposed at points where the columns and the rows intersect. In another embodiment, the first antenna array 820 may include two columns and two rows, and the antenna element 600 may be disposed at points where the columns and the rows intersect.

Figure 9:
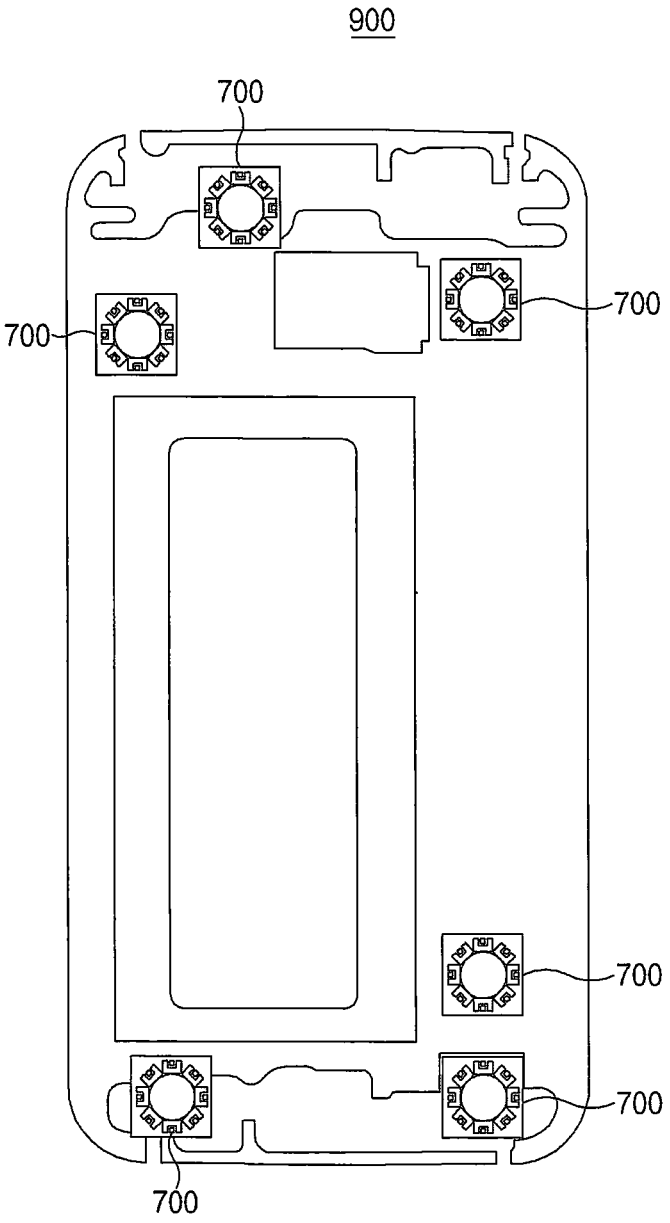
FIG. 9 illustrates side housing in which an antenna unit is positioned, according to an embodiment.

FIG. 9 illustrates side housing in which an antenna unit is positioned, according to an embodiment.

Referring to FIG. 9, the antenna unit 700 may be disposed in the partial region of side housing 900 (e.g., the side housing 114 of FIG. 1). For example, the antenna unit 700 may be attached to the region formed of plastic injection molding material, in the side housing 900. Moreover, the antenna unit 700 may be attached to the surface facing the rear cover 112, in the side housing 900. In another embodiment, the antenna unit 700 may be attached to the surface facing a PCB (e.g., the PCB 140 of FIG. 1), in the side housing 900.

According to an embodiment, the number of antenna units 700 disposed in the side housing 900 may be one or may be plural. For example, as illustrated in FIG. 9, the antenna unit 700 may be disposed in six regions and may be disposed in at least one or more regions of the six regions.

According to an embodiment, the antenna arrays 810, 820, and 830 illustrated in FIG. 8, not the antenna unit may be disposed in the partial region of the side housing 900. Also, the antenna unit 200 illustrated in FIG. 2A may be disposed in the partial region; the antenna unit 300 illustrated in FIG. 3A may be disposed in the partial region; alternatively, the antenna unit 600 illustrated in FIG. 6A may be disposed in the partial region.

Figure 10A:
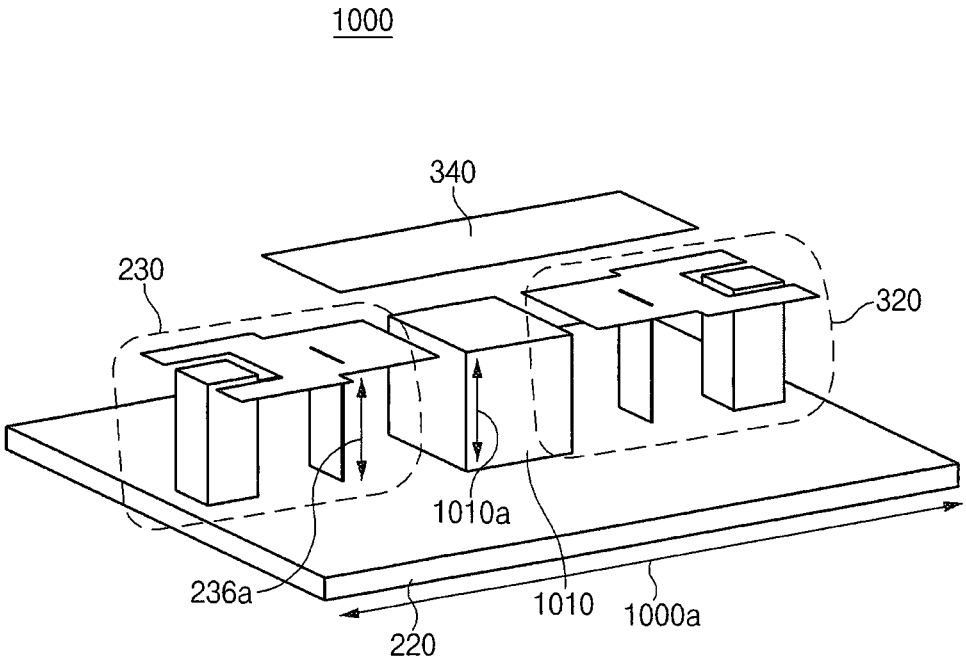
FIG. 10A illustrates an antenna unit, according to still another embodiment
Figure 10B:
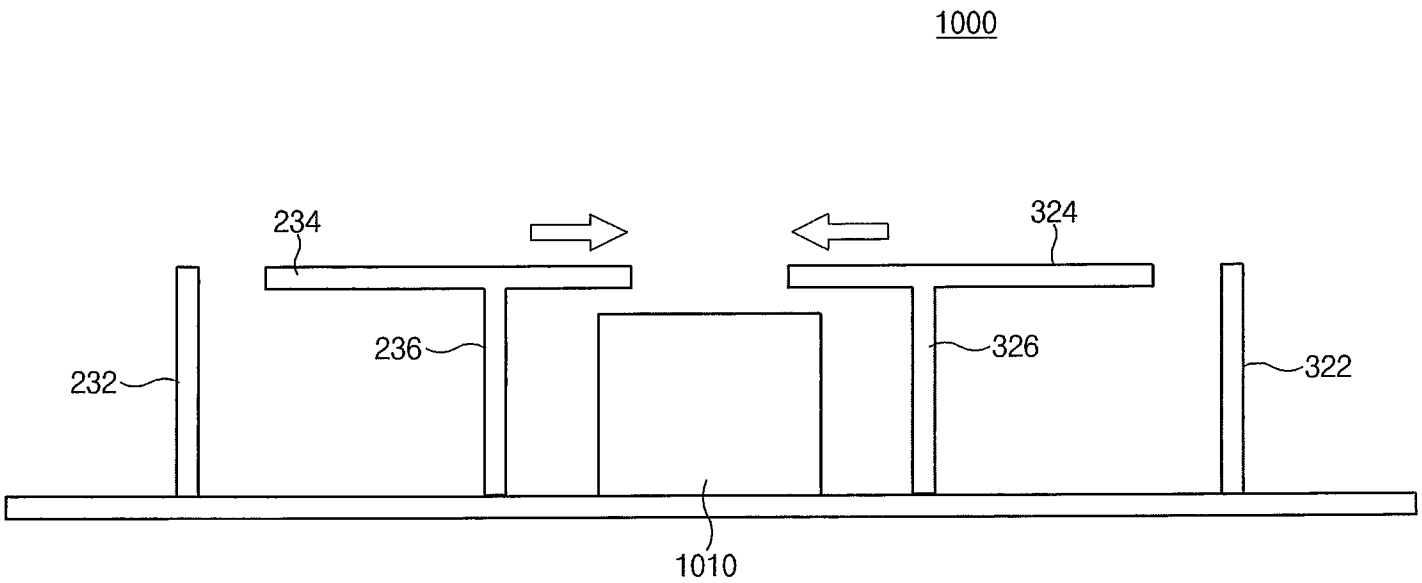
FIG. 10B illustrates a view schematically illustrating an antenna unit, according to still another embodiment.

FIG. 10A illustrates an antenna unit, according to still another embodiment. An antenna unit 1000 illustrated in FIG. 10A indicates an antenna unit in which the antenna elements 230 and 320 have a shorter distance than the antenna unit 300 illustrated in FIG. 3A. FIG. 10B illustrates a view schematically illustrating an antenna unit, according to still another embodiment. For example, FIG. 10B is a view schematically illustrating the antenna unit 1000 illustrated in FIG. 10A.

Referring to FIG. 10A, the antenna unit 1000 may include the first antenna element 230, the second antenna element 320, the central radiator 340, and a central member 1010. When the central member 330 illustrated in FIG. 3A is compared with the central member 1010 illustrated in FIG. 10A, the central member 330 may extend from the ground layer 220 to a plane on which the first radiator 234 and the second radiator 324 are positioned. For example, at least part of the central member 330 may be present between the first radiator 234 and the second radiator 324. On the other hand, the central member 1010 of FIG. 10A may extend to a point between the ground layer 220 and the plane. That is, a length 1010*a* of the central member 1010 may be shorter than a distance 236*a* between the first radiator 234 or the second radiator 324 and the ground layer 220.

Referring to FIGS. 10A and 10B, because the length 1010*a* of the central member 1010 is shorter than the distance 236*a* between the first radiator 234 or the second radiator 324 and the ground layer 220, the first antenna element 230 and the second antenna element 320 may move in the direction of the central member 1010. When the first antenna element 230 and the second antenna element 320 moves in the direction of the central member 1010, a length 1000*a* of the antenna unit 1000 may be also shortened. Although not illustrated, the above-described embodiment may be also applied to the antenna unit 600 and the antenna unit 700. The radiation pattern, antenna resonance, or antenna gain may be affected depending on the length of the central member 1010.

Figure 11A:
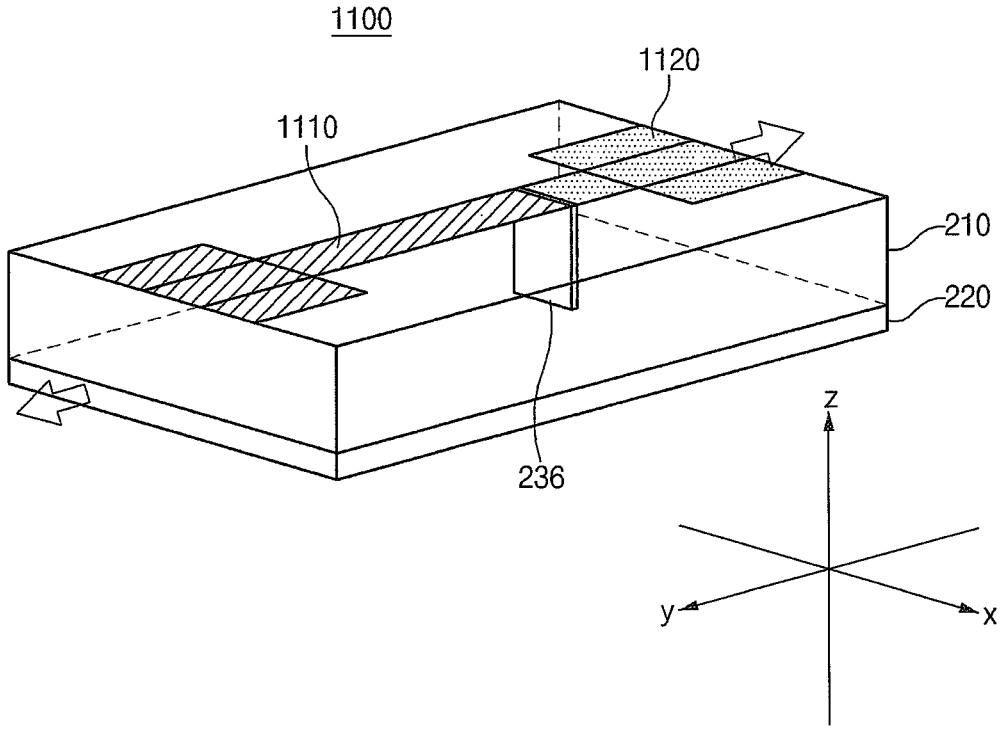
FIG. 11A illustrates an antenna unit, according to still another embodiment
Figure 11B:
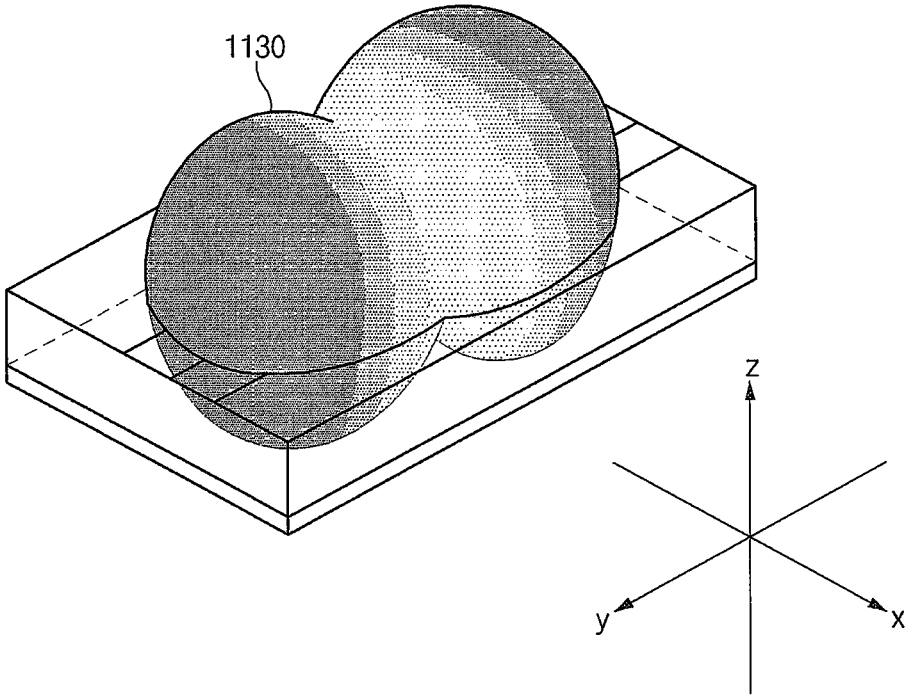
FIG. 11B illustrates a beam pattern, according to still another embodiment.
Figure 11C:
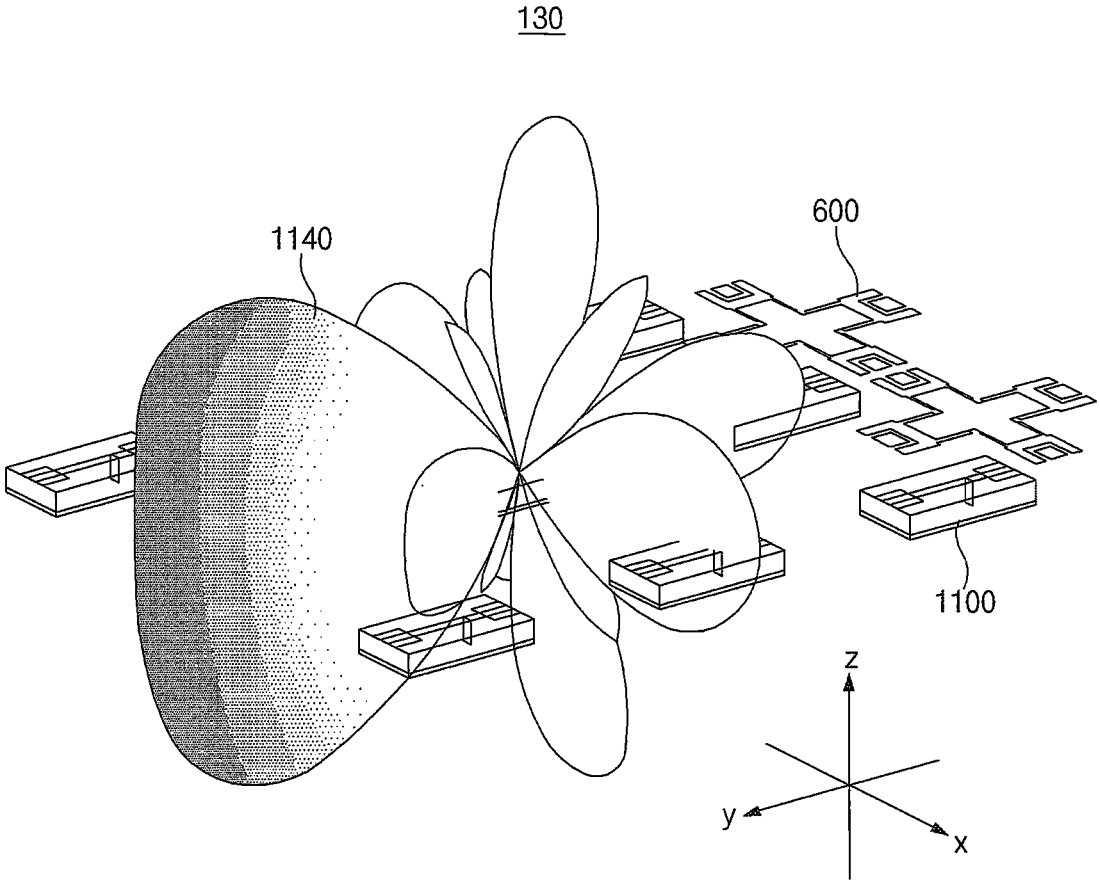
FIG. 11C illustrates a beam pattern and an antenna array, according to still another embodiment.

FIG. 11A illustrates an antenna unit, according to still another embodiment. FIG. 11B illustrates a beam pattern, according to still another embodiment. For example, a beam pattern 1130 illustrated in FIG. 11B indicates the beam pattern of an antenna unit 1100 illustrated in FIG. 11A. FIG. 11C illustrates a beam pattern and an antenna array, according to still another embodiment. For example, a beam pattern 1140 illustrated in FIG. 11C indicates a beam pattern in the case where the antenna unit 1100 illustrated in FIG. 11A is attached to the side housing 114.

Referring to FIG. 11A, the antenna unit 1100 may include the nonconductive layer 210, the ground layer 220, the feed part 236, a first radiator 1110, and a second radiator 1120.

The first radiator 1110 and the second radiator 1120 may extend in different directions from the feed part 236. For example, as illustrated in FIG. 11A, the first radiator 1110 may extend in 'y' direction; the second radiator 1120 may extend in '−y' direction. Although not illustrated, the first radiator 1110 may extend in 'x' direction; the second radiator 1120 may extend in '−x' direction.

Referring to FIGS. 11B and 11C, the antenna unit 1100 may radiate a signal in the side-surface direction (e.g., x-y plane direction) of the electronic device 100, unlike the antenna units 200, 300, 600, and 700. For example, because the first radiator 1110 faces 'y' direction, it may be identified that a part of the beam pattern 1130 faces 'y' direction in FIG. 11B. On the other hand, because the second radiator 1120 faces '−y' direction, it may be identified that the other part of the beam pattern 1130 faces '−y' direction.

According to an embodiment of the disclosure, referring to FIG. 11C, because the antenna array 130 includes both the antenna unit 600 and the antenna unit 1100, the antenna array 130 may radiate a signal in the vertical direction (e.g., 'z' direction or '−z' direction) and the side-surface direction (e.g., x-y plane direction). Referring to the beam pattern 1140 illustrated in FIG. 11C, it may be identified that the electronic device 100 radiates a signal in the vertical direction and the side-surface direction.

According to an embodiment of the disclosure, the electronic device 100 may include a housing 110 including a rear cover 112 and a cover glass 116 facing away from the rear cover 112, an antenna array 130 interposed between the rear cover 112 and the cover glass 116 and including at least one or more antenna units (e.g., 200 of FIG. 2A), a printed circuit board (PCB) 140 interposed between the antenna array 130 and the cover glass 116 and a communication circuit 114 disposed on the PCB 140 and configured to feed the antenna array 130. Each of the antenna units (e.g., 200 of FIG. 2A) may include a ground layer 220 and at least one or more antenna elements 230 disposed on the ground layer 220. Each of the antenna elements 230 may include a conductive member 232 extending from the ground layer 220, a radiator 234 having a specified spaced distance from the conductive member 232 and surrounding a part of the conductive member 232, and a feed part 236 electrically connecting the radiator 234 to the communication circuit 141. The communication circuit 141 may be configured to transmit/receive a signal of a specified frequency band through an electrical path formed via the antenna array 130.

According to an embodiment of the disclosure, each of the antenna units (e.g., 200 of FIG. 2A) may include a nonconductive layer 210 contacting the ground layer 220, and the nonconductive layer 210 may include a first surface 212, a second surface 214 interposed between the first surface 212 and the ground layer 220, and a side surface 216 surrounding a space between the first surface 212 and the second surface 214.

According to an embodiment of the disclosure, the first surface 212 may include a first region and a second region surrounding a part of the first region. The conductive member 232 may extend from the ground layer 220 to the first region, and at least part of the radiator 234 may be disposed in the second region.

According to an embodiment of the disclosure, the antenna elements 230 and 320 may include a first antenna element 230 and a second antenna element 320. Each of the antenna units may further include a central member 330 interposed between the first antenna element 230 and the second antenna element 320 and a central radiator 340 interposed between the central member 330 and the rear cover 112.

According to an embodiment of the disclosure, the communication circuit 141 may feed the antenna array 130 such that a phase difference between a current applied to the first antenna element 230 and a current applied to the second antenna element 320 has a specified value.

According to an embodiment of the disclosure, the central radiator 340 may extend from a first point to a second point on a plane positioned between the central member 330 and the rear cover 112. The first point may be positioned in a region corresponding to the first antenna element 230. The second point may be positioned in a region corresponding to the second antenna element 320.

According to an embodiment of the disclosure, a length between the first point and the second point may be longer than a length between one end and the other end of the radiator 234.

According to an embodiment of the disclosure, the second antenna element 320 may have a symmetrical structure with the first antenna element 230 with respect to the central member 330.

According to an embodiment of the disclosure, the central radiator 340 may be attached to the rear cover 112 through an adhesive material.

According to an embodiment of the disclosure, the antenna elements 610 and 620 may further include a third antenna element 610 and a fourth antenna element 620. The third antenna element 610 and the fourth antenna element 620 may have a symmetrical structure with respect to the central member 330.

According to an embodiment of the disclosure, the antenna elements 710, 720, 730, and 740 may further include a fifth antenna element 710, a sixth antenna element 720, a seventh antenna element 730, and an eighth antenna element 740. The fifth antenna element 710 and the sixth antenna element 720 may have a symmetrical structure with respect to the central member 330, and the seventh antenna element 730 and the eighth antenna element 740 may have a symmetrical structure with respect to the central member 330.

According to an embodiment of the disclosure, the electronic device 100 may further include a support member interposed between the PCB 140 and the cover glass 116.

According to an embodiment of the disclosure, the PCB 140 may include an opening in a specified region. The support member may support the antenna array 130 through the opening.

According to an embodiment of the disclosure, an antenna structure (e.g., 200 of FIG. 2A) may include a nonconductive layer 210 including a first surface 212, a second surface 214 facing away from the first surface 212, and a side surface 216 surrounding a space between the first surface 212 and the second surface 214, a ground layer 220 contacting the second surface 214, and at least one or more antenna elements 230 disposed on the ground layer 220. Each of the antenna elements 230 may include a conductive member 232 extending from the ground layer 220 to a third surface positioned between the first surface 212 and the second surface 214, a radiator 234 having a specified spaced distance from the conductive member 232 and surrounding a part of the conductive member 232 on the third surface, and a feed part 236 extending from the radiator 234 to a point between the second surface 214 and the third surface.

According to an embodiment of the disclosure, the antenna elements 230 and 320 may include a first antenna element 230 and a second antenna element 320. The antenna structure (e.g., 300 of FIG. 3A) may further include a central member 330 interposed between the first antenna element 230 and the second antenna element 320 and a central radiator 340 disposed in a region corresponding to the central member 330 in the first surface 212.

According to an embodiment of the disclosure, the first antenna element 230 and the second antenna element 320 may have a symmetrical structure with respect to the central member 330.

According to an embodiment of the disclosure, the antenna elements 610 and 620 may further include the third antenna element 610 and the fourth antenna element 620 that have a symmetric structure with respect to the central member 330.

According to an embodiment of the disclosure, the antenna elements 710, 720, 730, and 740 may further include the fifth antenna element 710, the sixth antenna element 720, the seventh antenna element 730, and the eighth antenna element 740. The first antenna element 230, the second antenna element 320, the third antenna element 610, the fourth antenna element 620, the fifth antenna element 710, the sixth antenna element 720, the seventh antenna element 730, and the eighth antenna element 740 may surround the central member 330.

According to an embodiment of the disclosure, the central radiator 340 may extend from a first point on the first surface 212 to a second point. The first point may be positioned in a region corresponding to the first antenna element 230. The second point may be positioned in a region corresponding to the second antenna element 320.

According to an embodiment of the disclosure, the length between the first point and the second point may be different from the length between one end and the other end of the radiator 234.

According to an embodiment of the disclosure, an electronic device may include housing 110 including a first plate 116 and a second plate 112 facing away from the first plate 116, a touch screen display 160 exposed through a part of the first plate 116, a wireless communication circuit 141 mounted on the PCB 140 interposed between the first plate 116 and the second plate 112 transmitting/receiving a signal in a frequency band, which is not less than 20 GHz, and at least one antenna array 130 coupled or connected with the PCB 140. The at least one antenna array 130 may include at least one or more antenna elements (e.g., 230 of FIG. 2A), a first layer in parallel with the second plate 112 and including a first conductive pattern 234 and a second conductive pattern 324 electrically separated from the first conductive pattern 234, a first conductive via 232, which extends vertically from the first layer, of which one end is electrically connected to the first conductive pattern 234, and of which the other end is electrically connected to the wireless the communication circuit 141, and a second conductive via 322, which extends vertically from the first layer, of which one end is electrically connected to the second conductive pattern 324, and of which the other end is electrically connected to the wireless the communication circuit 141.

According to an embodiment of the disclosure, the first layer may further include a third conductive pattern interposed between the first conductive pattern 234 and the second conductive pattern 324 and electrically separated from the first conductive pattern 234 and the second conductive pattern 324. The third conductive pattern may be electrically connected to the ground layer 220.

According to an embodiment of the disclosure, the first conductive pattern 234 and the second conductive pattern 324 may have a substantially symmetrical shape or may be disposed at a symmetrical location.

According to an embodiment of the disclosure, the wireless the communication circuit 141 may be configured to supply a transmit signal to the first conductive pattern 234 and may be configured to supply a transmit signal with inversion to the second conductive pattern 324.

According to an embodiment of the disclosure, the at least one antenna array 130 may include a plurality of columns and a plurality of rows. The at least one antenna elements may be disposed in at least one of points where the columns and the rows intersect.

According to an embodiment of the disclosure, the at least one antenna array 130 may be attached to the second plate 112.

According to an embodiment of the disclosure, the at least one antenna array 130 may be interposed between the second plate 112 and the PCB 140.

Figure 12:
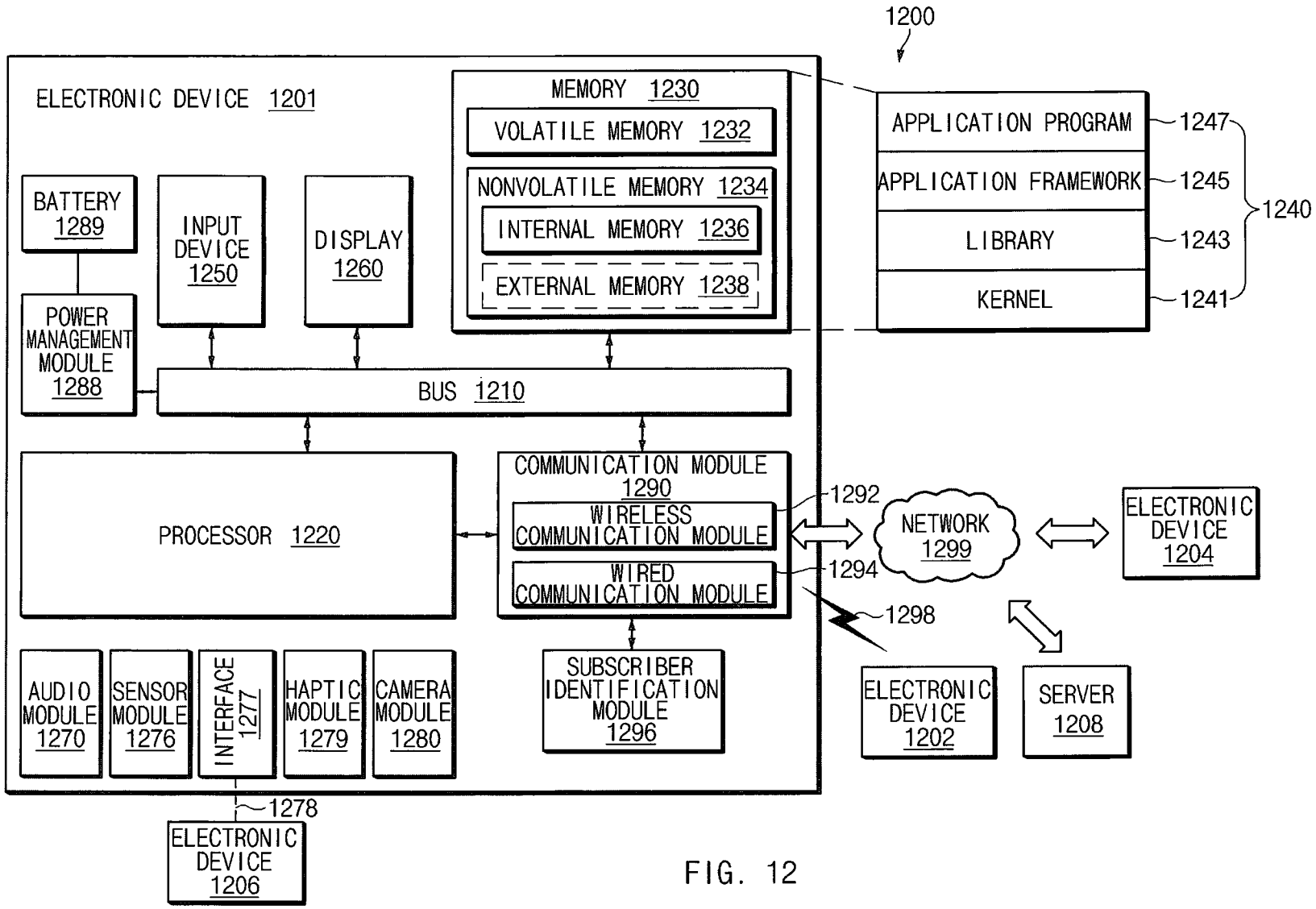
FIG. 12 illustrates an electronic device in a network environment, according to various embodiments.

FIG. 12 illustrates an electronic device in a network environment, according to various embodiments.

An electronic device according to various embodiments of the disclosure may include various forms of devices. For example, the electronic device may include at least one of, for example, portable communication devices (e.g., smartphones), computer devices (e.g., personal digital assistants (PDAs), tablet personal computers (PCs), laptop PCs, desktop PCs, workstations, or servers), portable multimedia devices (e.g., electronic book readers or Motion Picture Experts Group (MPEG-1 or MPEG-2) Audio Layer 3 (MP3) players), portable medical devices (e.g., heartbeat measuring devices, blood glucose monitoring devices, blood pressure measuring devices, and body temperature measuring devices), cameras, or wearable devices. The wearable device may include at least one of an accessory type (e.g., watches, rings, bracelets, anklets, necklaces, glasses, contact lens, or head-mounted-devices (HMDs)), a fabric or garment-integrated type (e.g., an electronic apparel), a body-attached type (e.g., a skin pad or tattoos), or a bio-implantable type (e.g., an implantable circuit). According to various embodiments, the electronic device may include at least one of, for example, televisions (TVs), digital versatile disk (DVD) players, audios, audio accessory devices (e.g., speakers, headphones, or headsets), refrigerators, air conditioners, cleaners, ovens, microwave ovens, washing machines, air cleaners, set-top boxes, home automation control panels, security control panels, game consoles, electronic dictionaries, electronic keys, camcorders, or electronic picture frames.

In another embodiment, the electronic device may include at least one of navigation devices, satellite navigation system (e.g., Global Navigation Satellite System (GNSS)), event data recorders (EDRs) (e.g., black box for a car, a ship, or a plane), vehicle infotainment devices (e.g., head-up display for vehicle), industrial or home robots, drones, automated teller machines (ATMs), points of sales (POSs), measuring instruments (e.g., water meters, electricity meters, or gas meters), or interne of things (e.g., light bulbs, sprinkler devices, fire alarms, thermostats, or street lamps). The electronic device according to an embodiment of the disclosure may not be limited to the above-described devices, and may provide functions of a plurality of devices like smartphones which have measurement function of personal biometric information (e.g., heart rate or blood glucose). In the disclosure, the term "user" may refer to a person who uses an electronic device or may refer to a device (e.g., an artificial intelligence electronic device) that uses the electronic device.

Referring to FIG. 12, under a network environment 1200, the electronic device 1201 (e.g., the electronic device 100) may communicate with an electronic device 1202 through short-range wireless communication 1298 or may communication with an electronic device 1204 or a server 1208 through a network 1299. According to an embodiment, the electronic device 1201 may communicate with the electronic device 1204 through the server 1208.

According to an embodiment, the electronic device 1201 may include a bus 1210, a processor 1220, a memory 1230, an input device 1250 (e.g., a micro-phone or a mouse), a display device 1260, an audio module 1270, a sensor module 1276, an interface 1277, a haptic module 1279, a camera module 1280, a power management module 1288, a battery 1289, a communication module 1290 (e.g., the communication circuit 141), and a subscriber identification module 1296. According to an embodiment, the electronic device 1201 may not include at least one (e.g., the display device 1260 or the camera module 1280) of the above-described components or may further include other component(s).

The bus 1210 may interconnect the above-described components 1220 to 1290 and may include a circuit for conveying signals (e.g., a control message or data) between the above-described components.

The processor 1220 may include one or more of a central processing unit (CPU), an application processor (AP), a graphic processing unit (GPU), an image signal processor (ISP) of a camera or a communication processor (CP). According to an embodiment, the processor 1220 may be implemented with a system on chip (SoC) or a system in package (SiP). For example, the processor 1220 may drive an operating system (OS) or an application program to control at least one of another component (e.g., hardware or software component) of the electronic device 1201 connected to the processor 1220 and may process and compute various data. The processor 1220 may load a command or data, which is received from at least one of other components (e.g., the communication module 1290), into a volatile memory 1232 to process the command or data and may store the result data into a nonvolatile memory 1234.

The memory 1230 may include, for example, the volatile memory 1232 or the nonvolatile memory 1234. The volatile memory 1232 may include, for example, a random access memory (RAM) (e.g., a dynamic RAM (DRAM), a static RAM (SRAM), or a synchronous DRAM (SDRAM)). The nonvolatile memory 1234 may include, for example, a programmable read-only memory (PROM), an one time PROM (OTPROM), an erasable PROM (EPROM), an electrically EPROM (EEPROM), a mask ROM, a flash ROM, a flash memory, a hard disk drive (HDD), or a solid-state drive (SSD). In addition, the nonvolatile memory 1234 may be configured in the form of an internal memory 1236 or the form of an external memory 1238 which is available through connection only if necessary, according to the connection with the electronic device 1201. The external memory 1238 may further include a flash drive such as compact flash (CF), secure digital (SD), micro secure digital (Micro-SD), mini secure digital (Mini-SD), extreme digital (xD), a multimedia card (MMC), or a memory stick. The external memory 1238 may be operatively or physically connected with the electronic device 1201 in a wired manner (e.g., a cable or a universal serial bus (USB)) or a wireless (e.g., Bluetooth) manner.

For example, the memory 1230 may store, for example, at least one different software component, such as a command or data associated with the program 1240, of the electronic device 1201. The program 1240 may include, for example, a kernel 1241, a library 1243, an application framework 1245 or an application program (interchangeably, "application") 1247.

The input device 1250 may include a microphone, a mouse, or a keyboard. According to an embodiment, the keyboard may include a keyboard physically connected or a virtual keyboard displayed through the display device 1260.

The display device 1260 may include a display, a hologram device or a projector, and a control circuit to control a relevant device. The display may include, for example, a liquid crystal display (LCD), a light emitting diode (LED) display, an organic LED (OLED) display, a microelectromechanical systems (MEMS) display, or an electronic paper display. According to an embodiment, the display may be flexibly, transparently, or wearably implemented. The display may include a touch circuitry, which is able to detect a user's input such as a gesture input, a proximity input, or a hovering input or a pressure sensor (interchangeably, a force sensor) which is able to measure the intensity of the pressure by the touch. The touch circuit or the pressure sensor may be implemented integrally with the display or may be implemented with at least one sensor separately from the display. The hologram device may show a stereoscopic image in a space using interference of light. The projector may project light onto a screen to display an image. The screen may be located inside or outside the electronic device 1201.

The audio module 1270 may convert, for example, from a sound into an electrical signal or from an electrical signal into the sound. According to an embodiment, the audio module 1270 may acquire sound through the input device 1250 (e.g., a microphone) or may output sound through an output device (not illustrated) (e.g., a speaker or a receiver) included in the electronic device 1201, an external electronic device (e.g., the electronic device 1202 (e.g., a wireless speaker or a wireless headphone)) or an electronic device 1206 (e.g., a wired speaker or a wired headphone) connected with the electronic device 1201

The sensor module 1276 may measure or detect, for example, an internal operating state (e.g., power or temperature) of the electronic device 1201 or an external environment state (e.g., an altitude, a humidity, or brightness) to generate an electrical signal or a data value corresponding to the information of the measured state or the detected state. The sensor module 1276 may include, for example, at least one of a gesture sensor, a gyro sensor, a barometric pressure sensor, a magnetic sensor, an acceleration sensor, a grip sensor, a proximity sensor, a color sensor (e.g., a red, green, blue (RGB) sensor), an infrared sensor, a biometric sensor (e.g., an iris sensor, a fingerprint senor, a heartbeat rate monitoring (HRM) sensor, an e-nose sensor, an electromyography (EMG) sensor, an electroencephalogram (EEG) sensor, an electrocardiogram (ECG) sensor), a temperature sensor, a humidity sensor, an illuminance sensor, or an UV sensor. The sensor module 1276 may further include a control circuit for controlling at least one or more sensors included therein. According to an embodiment, the electronic device 1201 may control the sensor module 1276 by using the processor 1220 or a processor (e.g., a sensor hub) separate from the processor 1220. In the case that the separate processor (e.g., a sensor hub) is used, while the processor 1220 is in a sleep state, the separate processor may operate without awakening the processor 1220 to control at least a portion of the operation or the state of the sensor module 1276.

According to an embodiment, the interface 1277 may include a high definition multimedia interface (HDMI), a universal serial bus (USB), an optical interface, a recommended standard 232 (RS-232), a D-subminiature (D-sub), a mobile high-definition link (MHL) interface, a SD card/MMC (multi-media card) interface, or an audio interface. A connector 1278 may physically connect the electronic device 1201 and the electronic device 1206. According to an embodiment, the connector 1278 may include, for example, an USB connector, an SD card/MMC connector, or an audio connector (e.g., a headphone connector).

The haptic module 1279 may convert an electrical signal into mechanical stimulation (e.g., vibration or motion) or into electrical stimulation. For example, the haptic module 1279 may apply tactile or kinesthetic stimulation to a user. The haptic module 1279 may include, for example, a motor, a piezoelectric element, or an electric stimulator.

The camera module 1280 may capture, for example, a still image and a moving picture. According to an embodiment, the camera module 1280 may include at least one lens (e.g., a wide-angle lens and a telephoto lens, or a front lens and a rear lens), an image sensor, an image signal processor, or a flash (e.g., a light emitting diode or a xenon lamp).

The power management module 1288, which is to manage the power of the electronic device 1201, may constitute at least a portion of a power management integrated circuit (PMIC).

The battery 1289 may include a primary cell, a secondary cell, or a fuel cell and may be recharged by an external power source to supply power at least one component of the electronic device 1201.

The communication module 1290 may establish a communication channel between the electronic device 1201 and an external device (e.g., the first external electronic device 1202, the second external electronic device 1204, or the server 1208). The communication module 1290 may support wired communication or wireless communication through the established communication channel. According to an embodiment, the communication module 1290 may include a wireless communication module 1292 or a wired communication module 1294. The communication module 1290 may communicate with the external device through a first network 1298 (e.g. a short range communication network such as Bluetooth or infrared data association (IrDA)) or a second network 1299 (e.g., a wireless wide area network such as a cellular network) through a relevant module among the wireless communication module 1292 or the wired communication module 1294.

The wireless communication module 1292 may support, for example, cellular communication, short-range wireless communication, global navigation satellite system (GNSS) communication. The cellular communication may include, for example, long-term evolution (LTE), LTE Advance (LTE-A), code division multiple access (CDMA), wideband CDMA (WCDMA), universal mobile telecommunications system (UMTS), Wireless Broadband (WiBro), or Global System for Mobile Communications (GSM). The short-range wireless communication may include wireless fidelity (Wi-Fi), Wi-Fi Direct, light fidelity (Li-Fi), Bluetooth, Bluetooth low energy (BLE), ZigBee, near field communication (NFC), magnetic secure transmission (MST), radio frequency (RF), or a body area network (BAN). The GNSS may include at least one of a Global Positioning System (GPS), a Global Navigation Satellite System (Glonass), Beidou Navigation Satellite System (Beidou), the European global satellite-based navigation system (Galileo), or the like. In the disclosure, "GPS" and "GNSS" may be interchangeably used.

According to an embodiment, when the wireless communication module 1292 supports cellar communication, the wireless communication module 1292 may, for example, identify or authenticate the electronic device 1201 within a communication network using the subscriber identification module (e.g., a SIM card) 1296. According to an embodiment, the wireless communication module 1292 may include a communication processor (CP) separate from the processor 1220 (e.g., an application processor (AP)). In this case, the communication processor may perform at least a portion of functions associated with at least one of components 1210 to 1296 of the electronic device 1201 in substitute for the processor 1220 when the processor 1220 is in an inactive (sleep) state, and together with the processor 1220 when the processor 1220 is in an active state. According to an embodiment, the wireless communication module 1292 may include a plurality of communication modules, each supporting only a relevant communication scheme among cellular communication, short-range wireless communication, or a GNSS communication.

The wired communication module 1294 may include, for example, a local area network (LAN) service, a power line communication, or a plain old telephone service (POTS).

For example, the first network 1298 may employ, for example, Wi-Fi direct or Bluetooth for transmitting or receiving commands or data through wireless direct connection between the electronic device 1201 and the first external electronic device 1202. The second network 1299 may include a telecommunication network (e.g., a computer network such as a LAN or a WAN, the Internet or a telephone network) for transmitting or receiving commands or data between the electronic device 1201 and the second electronic device 1204.

According to various embodiments, the commands or the data may be transmitted or received between the electronic device 1201 and the second external electronic device 1204 through the server 1208 connected with the second network 1299. Each of the first and second external electronic devices 1202 and 1204 may be a device of which the type is different from or the same as that of the electronic device 1201. According to various embodiments, all or a part of operations that the electronic device 1201 will perform may be executed by another or a plurality of electronic devices (e.g., the electronic devices 1202 and 1204 or the server 1208). According to an embodiment, in the case that the electronic device 1201 executes any function or service automatically or in response to a request, the electronic device 1201 may not perform the function or the service internally, but may alternatively or additionally transmit requests for at least a part of a function associated with the electronic device 1201 to any other device (e.g., the electronic device 1202 or 1204 or the server 1208). The other electronic device (e.g., the electronic device 1202 or 1204 or the server 1208) may execute the requested function or additional function and may transmit the execution result to the electronic device 1201. The electronic device 1201 may provide the requested function or service using the received result or may additionally process the received result to provide the requested function or service. To this end, for example, cloud computing, distributed computing, or client-server computing may be used.

Various embodiments of the disclosure and terms used herein are not intended to limit the technologies described in the disclosure to specific embodiments, and it should be understood that the embodiments and the terms include modification, equivalent, and/or alternative on the corresponding embodiments described herein. With regard to description of drawings, similar components may be marked by similar reference numerals. The terms of a singular form may include plural forms unless otherwise specified. In the disclosure disclosed herein, the expressions "A or B", "at least one of A and/or B", "A, B, or C", or "at least one of A, B, and/or C", and the like used herein may include any and all combinations of one or more of the associated listed items.

Expressions such as "first," or "second," and the like, may express their components regardless of their priority or importance and may be used to distinguish one component from another component but is not limited to these components. When an (e.g., first) component is referred to as being "(operatively or communicatively) coupled with/to" or "connected to" another (e.g., second) component, it may be directly coupled with/to or connected to the other component or an intervening component (e.g., a third component) may be present.

According to the situation, the expression "adapted to or configured to" used herein may be interchangeably used as, for example, the expression "suitable for", "having the capacity to", "changed to", "made to", "capable of" or "designed to" in hardware or software. The expression "a device configured to" may mean that the device is "capable of" operating together with another device or other parts. For example, a "processor configured to (or set to) perform A, B, and C" may mean a dedicated processor (e.g., an embedded processor) for performing corresponding operations or a generic-purpose processor (e.g., a central processing unit (CPU) or an application processor (AP)) which performs corresponding operations by executing one or more software programs which are stored in a memory device (e.g., the memory 1230).

The term "module" used herein may include a unit, which is implemented with hardware, software, or firmware, and may be interchangeably used with the terms "logic", "logical block", "part", "circuit", or the like. The "module" may be a minimum unit of an integrated part or a part thereof or may be a minimum unit for performing one or more functions or a part thereof. The "module" may be implemented mechanically or electronically and may include, for example, an application-specific IC (ASIC) chip, a field-programmable gate array (FPGA), and a programmable-logic device for performing some operations, which are known or will be developed.

At least a part of an apparatus (e.g., modules or functions thereof) or a method (e.g., operations) according to various embodiments may be, for example, implemented by instructions stored in a computer-readable storage media (e.g., the memory 1230) in the form of a program module. The instruction, when executed by a processor (e.g., the processor 1220), may cause the processor to perform a function corresponding to the instruction. The computer-readable recording medium may include a hard disk, a floppy disk, a magnetic media (e.g., a magnetic tape), an optical media (e.g., a compact disc read only memory (CD-ROM) and a digital versatile disc (DVD), a magneto-optical media (e.g., a floptical disk)), an embedded memory, and the like. The one or more instructions may contain a code made by a compiler or a code executable by an interpreter.

Each component (e.g., a module or a program module) according to various embodiments may be composed of single entity or a plurality of entities, a part of the above-described sub-components may be omitted, or other sub-components may be further included. Alternatively or additionally, after being integrated in one entity, some components (e.g., a module or a program module) may identically or similarly perform the function executed by each corresponding component before integration. According to various embodiments, operations executed by modules, program modules, or other components may be executed by a successive method, a parallel method, a repeated method, or a heuristic method, or at least one part of operations may be executed in different sequences or omitted. Alternatively, other operations may be added.

Figure 13:
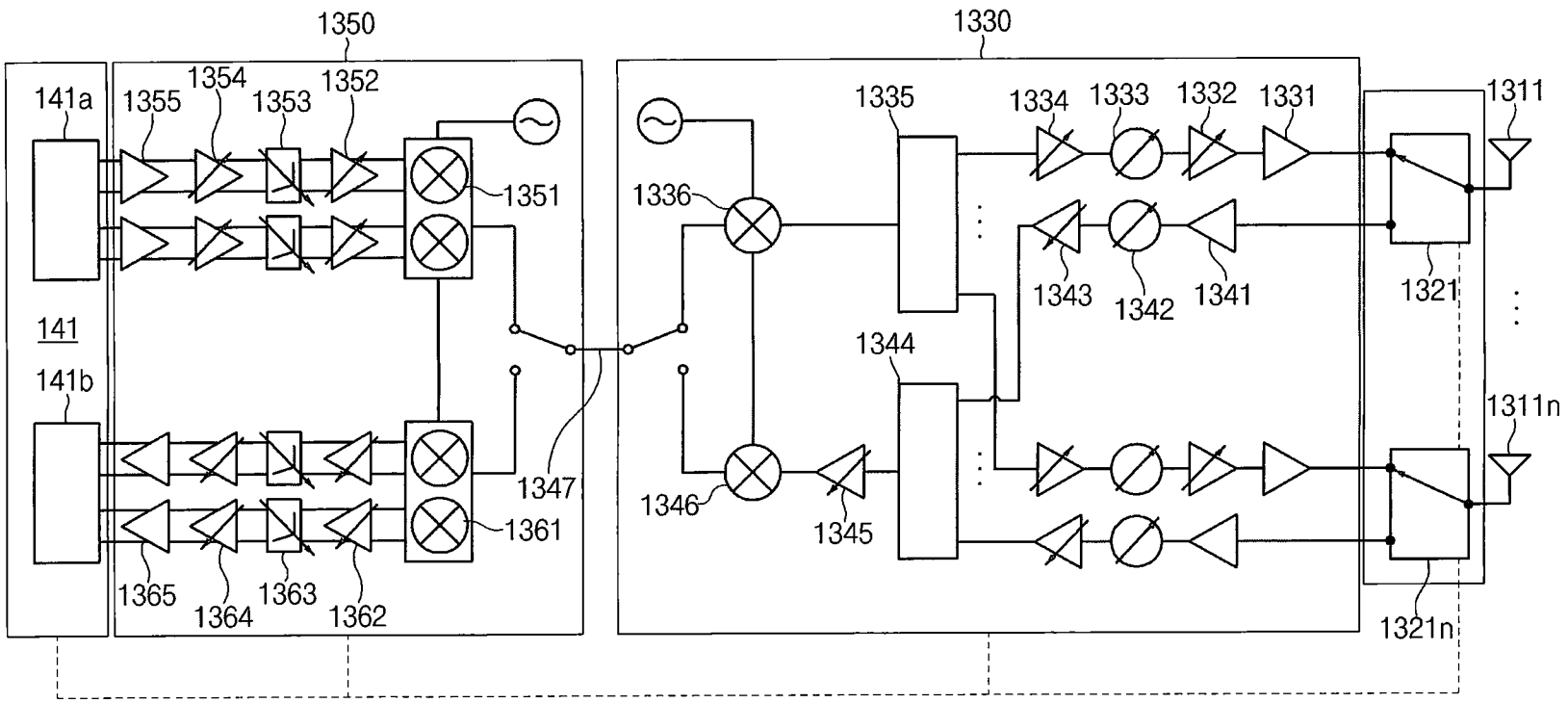
FIG. 13 illustrates a circuit diagram connecting a communication circuit to antenna units, according to an embodiment.

FIG. 13 illustrates a circuit diagram connecting a communication circuit to antenna units, according to an embodiment.

Referring to FIG. 13, a communication circuit (e.g., the communication circuit 141 of FIG. 1) and antenna units 1311 to 1311*n* may be spaced by a specified distance. A first circuit 1330 and a second circuit 1350 may be disposed between the communication circuit and the antenna units 1311 to 1311*n* spaced by the specified spaced distance; the communication circuit 141 and the antenna units 1311 to 1311*n* may be electrically connected to each other via the first circuit 1330 and the second circuit 1350. For example, the first circuit 1330 may be referred to as a "Radio Frequency (RF) circuit"; the second circuit 1350 may be referred to as an Inter Frequency (IF) circuit or IF processing integrated circuit.

According to an embodiment, the antenna units 1311 to 1311*n* may be connected to the first circuit 1330 via switches 1321 to 1321*n*. For example, when a signal is transmitted, the switch 1321 may connect the antenna unit 1311 to a power amplifier (PA) 1331; when the signal is received, the switch 1321 may connect the antenna unit 1311 to a Low Noise Amplifier (LNA) 1341.

First, when the path (hereinafter referred to as a "transmit path") for transmitting signal is described, the PA 1331, a first variable gain amp (VGA) 1332, a phase shifter (PS) 1333, a second VGA 1334, a TX splitter 1335, and a mixer 1336 may be disposed on the transmit path. The PA 1331 may amplify the power of the transmit signal. The PA 1331 may be mounted inside or outside the first circuit 1330. The first VGA 1332 and the second VGA 1334 may perform a transmit auto gain control (AGC) operation under control of the communication circuit 141. The number of VGAs may be two or more or may be less than two, in some cases. The PS 1333 may transition the phase of a signal depending on the angle of beamforming under control of the communication circuit 141. The TX splitter 1335 may divide the transmit signal from the mixer 1336 into "n" signals. The mixer 1336 may convert a Tx-IF (e.g., a transmit IF) signal received from the second circuit 1350 (e.g., IF processing integrated circuit) into a transmit signal (e.g., an RF band). The mixer may receive a signal to be mixed from an internal or external oscillator.

In another embodiment, when the path (hereinafter referred to as a "receive path") for receiving a signal is described, the LNA 1341, a PS 1342, a first VGA 1343, a combiner 1344, a second VGA 1345, and a mixer 1346 may be disposed on the receive path.

The LNA 1341 may amplify a signal received from the antenna unit 1311. The first VGA 1343 and the second VGA 1345 may perform a reception AGC operation under control of the communication circuit 141. The number of VGAs may be two or more or may be less than two, in some cases. The PS 1342 may transition the phase of a signal depending on the angle of beamforming under control of the communication circuit 141. The combiner 1344 may combine signals that are aligned to the same phase through a phase shift operation. The combined signal may be provided to the mixer 1346 through the second VGA 1345. The mixer 1346 may convert the received signal from an RF band into an IF band. The mixer 1346 may receive a signal to be mixed from an internal or external oscillator.

The switch 1347 that selectively connects the transmit path/receive path may be positioned behind the mixer 1346 in the first circuit 1330. When an IF frequency is high, it is difficult to connect to the transmission line between the first circuit 1330 and the second circuit 1350. When the switch 1347 selectively connects the transmit path/receive path, the number of transmission lines of the first circuit 1330/the second circuit 1350 may be reduced. The switch 1347 that selectively connects the transmit path/receive path such as the first circuit 1330 may be positioned in the second circuit 1350.

A mixer 1351, a third VGA 1352, a low pass filter (LPF) 1353, a fourth VGA 1354, and a buffer 1355 may be disposed on the transmit path inside the second circuit 1350. The buffer 1355 may function as a buffer upon receiving a balanced Tx I/Q signal from the communication circuit 141, thus making it possible to process the signal stably. The third VGA 1352 and the fourth VGA 1354 may perform the transmit AGC operation under control of the communication circuit 141. The LPF 1353 may function as a channel filter by operating the bandwidth of the Tx IQ signal of a base band as a cutoff frequency. It is possible to change the cutoff frequency. The mixer 1351 may convert the balanced Tx I/Q signal to a Tx-IF signal.

A mixer 1361, a third VGA 1362, an LPF 1363, a fourth VGA 1364, and a buffer 1365 may be disposed on the receive path of the second circuit 1350. The buffer 1365 may function as a buffer upon delivering a balanced Rx I/Q signal to the communication circuit 141 from the fourth VGA 1364, thus making it possible to process a signal stably. The third VGA 1362 and the fourth VGA 1364 may function as the Rx AGC under control of the communication circuit 141. The LPF 1363 may function as a channel filter by operating the bandwidth of the balanced Rx IQ signal of a base band as a cutoff frequency. It is possible to change the cutoff frequency. The mixer 1361 may generate the balanced Rx I/Q signal through the conversion to the Rx-IF signal.

A Tx I/Q DAC 141*a* in the communication circuit 141 may convert the digital signal modulated by a MODEM to the balanced Tx I/Q signal and then may deliver the balanced Tx I/Q signal to the second circuit 1350. A Rx I/Q ADC 141*b* in the communication circuit 141 may convert the balanced Rx I/Q signal converted by the second circuit 1350, to the digital signal to deliver the digital signal to the MODEM.

The invention claimed is:

1. An electronic device comprising:

a housing including a rear cover and a cover glass facing away from the rear cover;

an antenna array interposed between the rear cover and the cover glass and including at least one or more antenna units;

a printed circuit board (PCB) interposed between the antenna array and the cover glass; and a communication circuit disposed on the PCB and configured to feed the antenna array, wherein each of the antenna units includes a ground layer and at least one or more antenna elements disposed on the ground layer, wherein each of the antenna elements includes:

a conductive member extending from the ground layer;

a radiator having a specified spaced distance from the conductive member and surrounding a part of the conductive member; and a feed part electrically connecting the radiator to the communication circuit, and wherein the communication circuit is configured to transmit/receive a signal of a specified frequency band through an electrical path formed via the antenna array.

2. The electronic device of claim 1, wherein each of the antenna units includes a nonconductive layer contacting the ground layer, and wherein the nonconductive layer includes a first surface, a second surface interposed between the first surface and the ground layer, and a side surface surrounding a space between the first surface and the second surface.

3. The electronic device of claim 2, wherein the first surface includes a first region and a second region surrounding a part of the first region, wherein the conductive member extends from the ground layer to the first region, and wherein at least part of the radiator is disposed in the second region.

4. The electronic device of claim 1, wherein the antenna elements include a first antenna element and a second antenna element, and wherein each of the antenna units further includes:

a central member interposed between the first antenna element and the second antenna element; and a central radiator interposed between the central member and the rear cover.

5. The electronic device of claim 4, wherein the communication circuit feeds the antenna array such that a phase difference between a current applied to the first antenna element and a current applied to the second antenna element has a specified value.

6. The electronic device of claim 4, wherein the central radiator extends from a first point to a second point on a plane positioned between the central member and the rear cover, wherein the first point is positioned in a region corresponding to the first antenna element, and wherein the second point is positioned in a region corresponding to the second antenna element.

7. The electronic device of claim 6, wherein a length between the first point and the second point is longer than a length between one end and the other end of the radiator.

8. The electronic device of claim 4, wherein the second antenna element has a symmetrical structure with the first antenna element with respect to the central member.

9. The electronic device of claim 4, wherein the central radiator is attached to the rear cover through an adhesive material.

10. The electronic device of claim 4, wherein the antenna elements further include a third antenna element and a fourth antenna element, and wherein the third antenna element and the fourth antenna element have a symmetrical structure with respect to the central member.

11. The electronic device of claim 10, wherein the antenna elements further include a fifth antenna element, a sixth antenna element, a seventh antenna element, and an eighth antenna element, wherein the fifth antenna element and the sixth antenna element have a symmetrical structure with respect to the central member, and wherein the seventh antenna element and the eighth antenna element have a symmetrical structure with respect to the central member.

12. The electronic device of claim 1, further comprising:

a support member interposed between the PCB and the cover glass.

13. The electronic device of claim 12, wherein the PCB includes an opening in a specified region, and wherein the support member supports the antenna array through the opening.

* * * * *